US010179255B2

(12) United States Patent
Almeida et al.

(10) Patent No.: US 10,179,255 B2
(45) Date of Patent: Jan. 15, 2019

(54) FIRE PROTECTION SPRINKLER ASSEMBLY

(71) Applicant: TYCO FIRE PRODUCTS LP, Lansdale, PA (US)

(72) Inventors: Jose L. Almeida, Warwick, RI (US); Kenneth W. Rogers, Horsham, PA (US)

(73) Assignee: Tyco Fire Products LP, Lansdale, PA (US)

( * ) Notice: Subject to any disclaimer, the term of this patent is extended or adjusted under 35 U.S.C. 154(b) by 473 days.

(21) Appl. No.: 14/775,662

(22) PCT Filed: Mar. 13, 2014

(86) PCT No.: PCT/US2014/026759

§ 371 (c)(1),
(2) Date: Sep. 11, 2015

(87) PCT Pub. No.: WO2014/151977

PCT Pub. Date: Sep. 25, 2014

(65) Prior Publication Data

US 2016/0023029 A1 Jan. 28, 2016

Related U.S. Application Data

(60) Provisional application No. 61/782,053, filed on Mar. 14, 2013, provisional application No. 61/782,171,
(Continued)

(51) Int. Cl.
*A62C 35/68* (2006.01)
*A62C 37/09* (2006.01)
(Continued)

(52) U.S. Cl.
CPC ..... *A62C 35/68* (2013.01); *A62C 37/09* (2013.01); *A62C 37/12* (2013.01); *B05B 1/265* (2013.01)

(58) Field of Classification Search
CPC ..... A62C 35/68; A62C 37/09; A62C 37/12; A62C 37/08; A62C 37/14; A62C 35/58;
(Continued)

(56) References Cited

U.S. PATENT DOCUMENTS 2,046,169 A * 6/1936 Knight ..... A62C 37/14 169/37
3,904,126 A 9/1975 Allard
(Continued)

FOREIGN PATENT DOCUMENTS

DE 202005014586 2/2007
FR 1408571 * 9/1965 ..... A62C 37/09
(Continued)

OTHER PUBLICATIONS

Kuwatch, Matthew, "The Benefirs of CPVC Fire-Sprinkler Systems," May 1, 2008, Buildings, May 2008, available at http://www.buildings.com/article-details/articleid/6009/title/the-benefits-of-cpvc-fire-sprinkler-systems.*
(Continued)

*Primary Examiner* — Alexander Valvis
*Assistant Examiner* — Christopher R Dandridge
(74) *Attorney, Agent, or Firm* — Foley & Lardner LLP

(57) ABSTRACT

A sprinkler assembly (10) includes a (plastic) sprinkler frame (12) and a deflector assembly (30) circumferentially disposed about the sprinkler frame. The deflector assembly includes a receiver portion (32), a deflector member (34), and at least one extension member (36) to space the deflector member from the receiver portion. The at least one extension member is peripheral with respect to the receiver portion and the deflector member. The sprinkler assembly can be configured with the deflector assembly translating with respect to the sprinkler frame. Alternatively, the deflector assembly can be fixed with respect to the sprinkler frame.

26 Claims, 13 Drawing Sheets

Related U.S. Application Data filed on Mar. 14, 2013, provisional application No. 61/782,616, filed on Mar. 14, 2013.

(51) Int. Cl.
*A62C 37/12* (2006.01)
*B05B 1/26* (2006.01)

(58) Field of Classification Search
CPC ..... A62C 35/60; A62C 35/62; A62C 37/11; B05B 1/265; B05B 1/262; B05B 1/3006
See application file for complete search history.

(56) References Cited

U.S. PATENT DOCUMENTS

| | | | | |
|---|---|---|---|---|
| 5,664,630 | A | 9/1997 | Meyer et al. | |
| 5,722,599 | A * | 3/1998 | Fries | A62C 31/02 169/37 |
| 5,921,322 | A * | 7/1999 | Bonfield | A62C 37/09 169/37 |
| 7,201,234 | B2 | 4/2007 | Rogers et al. | |
| 7,275,603 | B2 * | 10/2007 | Polan | A62C 37/09 169/37 |
| 8,074,725 | B2 | 12/2011 | Rogers et al. | |
| 8,151,897 | B1 | 4/2012 | Meyer et al. | |
| 8,353,356 | B2 * | 1/2013 | Rogers | A62C 35/68 169/37 |
| 9,174,078 | B2 * | 11/2015 | Fischer | A62C 37/08 |
| 2009/0126950 | A1 | 5/2009 | Rogers | |
| 2010/0263883 | A1 | 10/2010 | Abels et al. | |
| 2014/0346256 | A1 * | 11/2014 | Abels | A62C 31/28 239/518 |

FOREIGN PATENT DOCUMENTS

| | | |
|---|---|---|
| WO | WO2006/133057 | 12/2006 |
| WO | WO2011/116012 | 9/2011 |
| WO | WO2013/010098 | 1/2013 |

OTHER PUBLICATIONS

U.S. Appl. No. 61/782,616, filed Mar. 14, 2013.
U.S. Appl. No. 61/782,053, filed Mar. 14, 2013.
U.S. Appl. No. 61/782,171, filed Mar. 14, 2013.
International Search Report and Written Opinnion for International Application PCT/US2014/026759, Applicant Tyco Fire Products LP, dated Dec. 11, 2014, 82 pages.
European Patent Application No. 14716177.2, filed Mar. 13, 2014.
Blazemaster®CPVC sprinkler pipe and fitting—TFP1915: "Blazemaster CPVC Sprinkler Pipe and Fittings Submittal Sheet" (Jun. 2008) 2 pages.

* cited by examiner

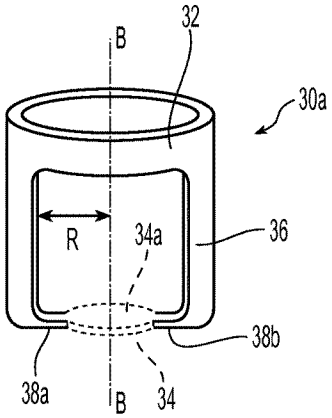
Fig. 2A
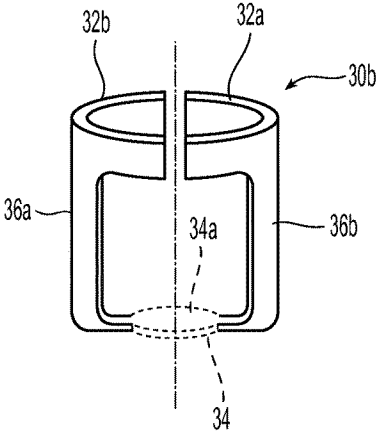
Fig. 2B
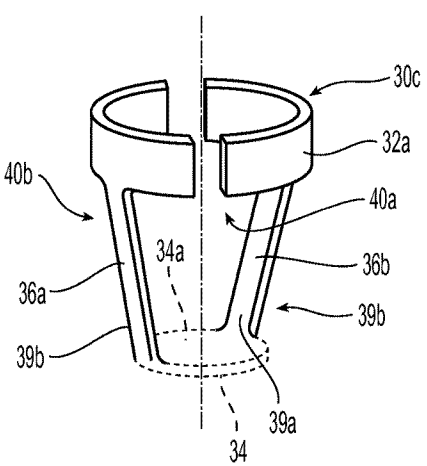
Fig. 2C
Fig. 2D
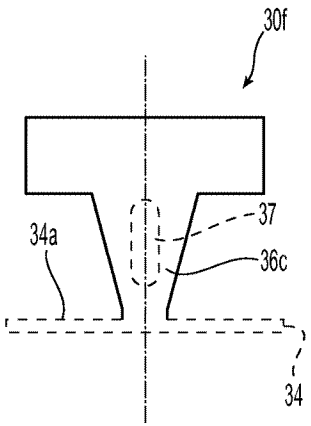
Fig. 2E
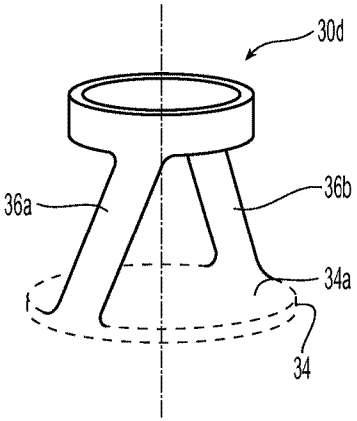
Fig. 2F

Fig. 2Aiii

Fig. 2Aii

FIRE PROTECTION SPRINKLER ASSEMBLY

CROSS REFERENCE TO RELATED APPLICATIONS

This application is a 35 U.S.C. § 371 application of International Application No. PCT/US2014/026759 filed Mar. 13, 2014, which claims the benefit of priority to U.S. Provisional Patent Application No. 61/782,053, filed Mar. 14, 2013, U.S. Provisional Patent Application No. 61/782,171, filed Mar. 14, 2013, and U.S. Provisional Patent Application Ser. No. 61/782,616, filed Mar. 14, 2013, each of which is incorporated by reference in its entirety.

TECHNICAL FIELD

The present invention relates generally to fire protection devices and, more specifically, sprinkler assemblies and the arrangement and operation of their components.

BACKGROUND OF THE INVENTION

Generally, known automatic fire protection sprinklers include a sprinkler frame or body with an inlet that that is connected to a supply of firefighting fluid under pressure. Disposed within the outlet of sprinkler body is a sealing element supported by a thermally responsive trigger to prevent the discharge of fluid from the outlet. In response to a sufficiently sized fire or other heat source, the thermally responsive trigger actuates thereby releasing the sealing element to permit discharge of fluid from the sprinkler outlet. The discharged fluid impacts a deflector member disposed at a distance from the outlet for distribution of the fluid. The deflector member can either be disposed in a fixed distance relationship with respect to the sprinkler outlet, i.e., a fixed deflector or alternatively, the deflector can translate with respect to the sprinkler outlet, e.g., a drop down deflector.

U.S. Pat. No. 5,664,630 shows and describes exemplary embodiments of fixed and drop down deflector sprinkler assemblies. FIG. 1 of U.S. Pat. No. 5,664,630 shows a one piece frame arm(s) and body sprinkler frame with a knuckle or apex formed at the end of the frame arms. Centrally affixed about the knuckle is a deflector. The deflector includes a central region that is disposed over an end of the knuckle and secured by swaging. Shown in FIGS. 2 and 3 of U.S. Pat. No. 5,664,630 is a concealed sprinkler having a translating or drop down deflector. The sprinkler includes a sprinkler body disposed about which is a deflector support. The deflector support includes a pair of arms which extend axially away from the outlet of the sprinkler body. The ends of the arms are flanged and bored to respectively support a pair of guide pins which slide within the bores. Coupled to the end of the guide pins is a deflecting structure for translation relative the sprinkler outlet. A pair of bores are formed in the deflecting structure through which the ends of the guide pins pass and are swaged to fix the deflecting structure to the guide pins. In order to provide sufficient surrounding material in the frame, frame structure or deflecting structure for supporting and/or securing the guide pins, the through bores are located on a planar surface that is radially inward of its perimeter. Accordingly, the guide pins are disposed radially inward of the deflecting structure and/or the periphery of the sprinkler frame or frame structure.

These known sprinkler assemblies can present some design limitations and manufacturing complexities. The fixed deflector assembly with the one piece frame, arms and knuckle defines only a single fixed distance between the deflector and the sprinkler outlet. Moreover, each of the fixed and translating deflector assemblies can involve manufacturing and assembly of multiple interconnected components including the guide pins or compression screws separate from the sprinkler frame, surrounding structure and/or deflector member. It may be desirable to provide sprinkler assemblies that overcome some of these design limitation while presenting a more simplified construction.

DISCLOSURE OF INVENTION

Embodiments of the present invention provide for preferred sprinkler assemblies. More specifically, preferred embodiments of the sprinkler assembly include a sprinkler frame and a deflector assembly circumferentially disposed about the sprinkler frame. The sprinkler frame is preferably formed from plastic; and a preferred embodiment of the deflector assembly includes a receiver portion, a deflector member, and at least one extension member to space the deflector member from the receiver portion. The at least one extension member is preferably peripheral with respect to the receiver portion and the deflector member. Preferably, the deflector assembly is a unitary structure. The sprinkler assembly can be configured with the deflector assembly translating with respect to the sprinkler frame. Alternatively, the deflector assembly can be fixed with respect to the sprinkler frame.

A preferred embodiment of the sprinkler assembly includes a sprinkler frame having a proximal portion, a distal portion and an intermediate portion extending between the proximal and distal portions. The sprinkler frame has an outer surface and an inner surface with the inner surface defining a fluid passageway extending from the proximal portion to the distal portion to define a sprinkler axis. The assembly further includes a deflector assembly having a receiver portion, a deflector member and at least one extension member disposed preferably peripherally and between the receiving portion and the deflector member to space the deflector member from the receiver portion along a central deflector axis. The at least one extension member is preferably peripheral with respect to the receiver portion and the deflector member. The receiver portion is disposed about the intermediate portion of the sprinkler frame to axially align the deflector axis with the sprinkler axis for translation of the deflector assembly relative to the sprinkler frame. In one particular embodiment, the distal portion of the sprinkler frame has an outer surface including a formation that limits the axial translation of the deflector assembly in the distal direction.

An alternate embodiment of the sprinkler assembly provides for a deflector assembly disposed in a fixed relation with respect to the sprinkler frame. The sprinkler assembly preferably includes a plastic sprinkler frame having a proximal portion, a distal portion and an intermediate portion extending between the proximal and distal portions. The sprinkler frame has an outer surface and an inner surface defining a fluid passageway extending from the proximal portion to the distal portion to define a sprinkler axis. A preferred deflector assembly includes a receiver portion, a deflector member and at least one extension member between the receiving portion and the deflector member to space the deflector member from the receiver portion along a central deflector axis. The at least one extension member is preferably peripheral with respect to the receiver portion and the deflector member. The at least one extension member preferably has at least one opening for engaging the outer surface of the sprinkler frame to fix the deflector assembly with respect to the sprinkler frame.

Embodiments of the present invention provide for sprinkler assemblies, their components and methods of installation. More specifically, preferred embodiments of the sprinkler assembly include a sprinkler frame and a deflector assembly circumferentially disposed about the sprinkler frame. The sprinkler frame is preferably formed from plastic; and a preferred embodiment of the deflector assembly includes a receiver portion, a deflector member, and at least one extension member to space the deflector member from the receiver portion. The at least one extension member is preferably peripheral with respect to the receiver portion and the deflector member. The sprinkler assembly can be configured with the deflector assembly translating with respect to the sprinkler frame.

A preferred embodiment of the sprinkler assembly includes a sprinkler frame having a proximal portion, a distal portion and an intermediate portion extending between the proximal and distal portion. The sprinkler frame has an outer surface and an inner surface, the inner surface defines a fluid passageway extending from the proximal portion to the distal portion to define a sprinkler axis. A preferred deflector assembly having a receiver portion is disposed about the intermediate portion of the sprinkler frame; and a support cup having an inner surface surrounding the sprinkler frame defines an annular space therebetween. The receiver portion is disposed in the annular space to axially align the deflector axis with the sprinkler axis for translation of the deflector assembly relative to the sprinkler frame. Moreover, the deflector assembly translates from a first proximal position to a second distal position, and the deflector assembly surrounds the sprinkler frame in each of the first and second position. A preferred embodiment of the deflector assembly includes a receiver portion, a deflector member, and at least one extension member to space the deflector member from the receiver portion. The at least one extension member is preferably peripheral with respect to the receiver portion and the deflector member. In a preferred embodiment, a cover plate assembly and an escutcheon are disposed about the support cup. The deflector assembly translates from a first proximal position to a second distal position, the cover plate supports the deflector assembly in the first proximal position to define an unactuated state of the sprinkler assembly.

Embodiments of a preferred sprinkler assembly provides for a sidewall sprinkler and more preferably a concealed horizontal sidewall sprinkler. Preferred embodiments of the sprinkler assembly include a sprinkler frame and a deflector assembly circumferentially disposed about the sprinkler frame. The deflector assembly includes a receiver portion preferably circumferentially disposed about the sprinkler frame, a deflector member, and at least one peripheral extension member to space the deflector member from the receiver portion. The at least one extension member is preferably peripheral with respect to the receiver portion and the deflector member. The deflector member is preferably a unitary structure having a face plate portion and a canopy portion. Due to the arrangement of the receiver and the extension members of the deflector assembly, the face plate portion preferably presents an initial impact surface to the outlet of the sprinkler that is preferably orthogonal to the outlet and intersecting the sprinkler axis.

A preferred method of forming a deflector assembly is provided. The preferred method includes any one of cutting, stamping or punching a deflector member, at least one extension member and at least receiver segment from a one piece planar blank. The method further includes disposing the extension member between the deflector member and the receiver segment. More preferably, terminal ends of the extension member are disposed at the peripheral edges of the deflector member and the receiver segment. Forming the deflector assembly includes bending the blank at the transition between the extension member and the deflector member and the receiver segment. The deflector assembly is preferably a unitary structure having a deflector member, and at least one peripheral extension member and a receiver portion. The at least one extension member is preferably formed peripheral with respect to the receiver portion and the deflector member. In one preferred embodiment, the method includes forming the deflector assembly with a deflector member, at least one extension member and a receiver portion. In another preferred embodiment, the method includes forming the deflector member with a face plate portion, a canopy portion and at least one of a void and a slot from the one-piece blank. The preferred forming further includes bending the canopy portion with respect to the face plate portion. Moreover, the receiving member is preferably bent or curved for appropriately receiving the sprinkler frame in a manner as previously described.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the exemplary embodiments of the invention.

FIGS. 2A-2G are preferred embodiments of a deflector assembly for use in the sprinkler assembly of FIGS. 1 and 1A.

FIGS. 2Ai-2Aiii show various geometries for use in the deflector assembly of FIGS. 2A-2F.

MODE(S) FOR CARRYING OUT THE INVENTION

Figure 1:
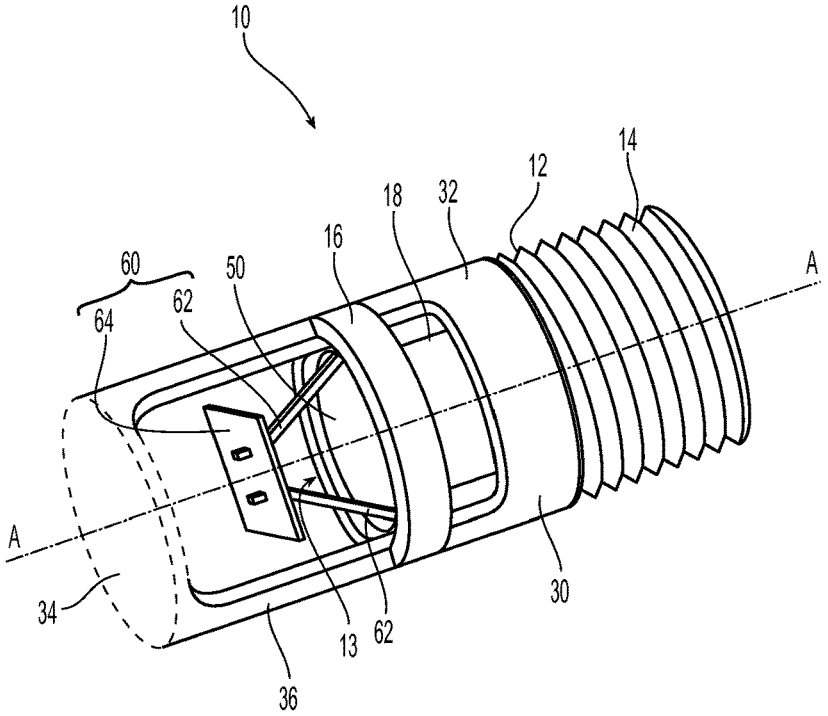
FIG. 1 is a perspective view of a preferred fire sprinkler assembly in an unactuated state.
Figure 1A:
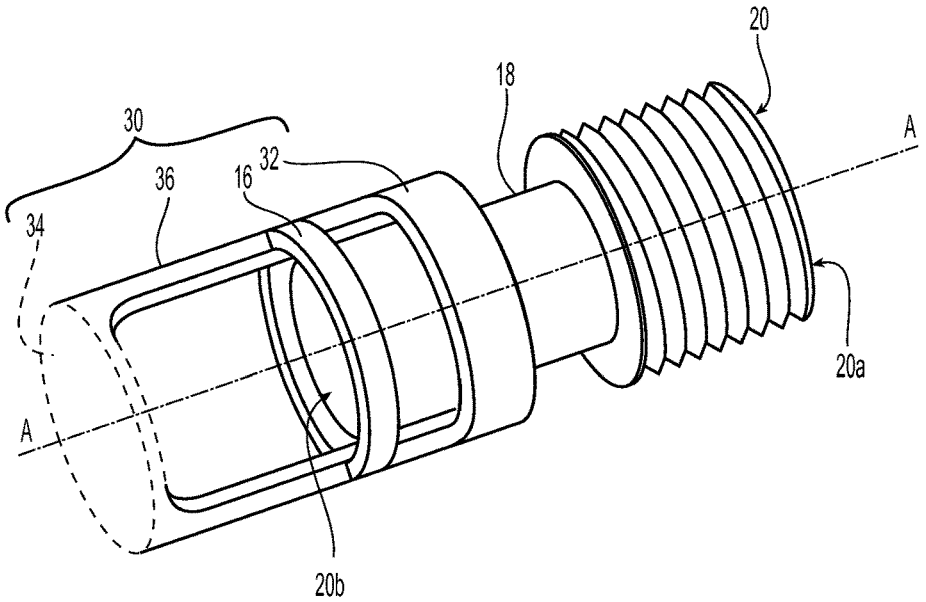
FIG. 1A is a perspective view of the preferred fire sprinkler assembly of FIG. 1 in an actuated state.

Shown in FIGS. 1 and 1A is a first illustrative embodiment of a preferred fire protection sprinkler assembly 10.

The preferred assembly 10 includes a sprinkler frame 12, preferably formed from a plastic, and a deflector assembly 30 circumferentially disposed about the sprinkler frame 12. The deflector assembly 30 is preferably configured to translate relative to the sprinkler frame 12. Alternatively, the deflector assembly 30 may be fixed relative to the sprinkler frame 12.

The sprinkler assembly 10 may be configured as either a pendent, a concealed pendent or a sidewall sprinkler in which the assembly 10 preferably includes operational components of a fire protection sprinkler, such as for example, i) an internal closure or seal assembly 50 for preventing discharge of firefighting fluid, i.e., water, from the sprinkler frame 12; and ii) a thermally responsive trigger assembly 60 which maintains the sprinkler assembly 10 in an unactuated state by maintaining the internal seal assembly 50 when coupled to a fire fighting fluid pipe supply. Upon thermal activation of the trigger assembly 60, the sprinkler assembly 10 is placed in an actuated state by releasing the seal assembly 50 for the discharge of water. In the preferred configuration and operation of the sprinkler assembly 10, the deflector assembly 30 axially translates with respect to the sprinkler frame 12 distally from a first unactuated position, shown in FIG. 1, to a second position, shown in FIG. 1A.

The deflector assembly 30 preferably includes a proximal portion and a distal portion with an extension therebetween to couple and space the distal portion from the proximal portion. As shown, the proximal portion of the deflector assembly 30 defines a receiver portion 32 which preferably surrounds and more preferably circumferentially surrounds the sprinkler frame 12. The distal portion of the sprinkler assembly 30 includes a deflector member 34 configured for distribution of water discharged from the outlet 20*b* to address a fire. Extending between the receiver 32 and the deflector member 34 is one or more extension members 36. The extension member(s) 36 space the deflector member 34 from the receiver portion 32 and more particularly axially locate the deflector member 34 from the outlet 20*b*. The extension member 36 is preferably peripheral with respect to the receiver portion 32 and the deflector member 34. Preferably, the deflector assembly 30 is a unitary structure.

Shown in FIGS. 2A-2F and 3A-3C are various embodiments of the deflector assembly 30. The receiver portion 32 defines a central axis B-B of the deflector assembly 30 and the extension members 36 couple the deflector member 34 to the receiver 32 so as to preferably centrally align the deflector member 34 along the central axis B-B as illustratively shown in the deflector assembly 30*a* of FIG. 2A. Because the sprinkler frame 12 translates within the receiver portion 32 upon sprinkler actuation, the receiver portion 32 is geometrically configured to surround and more preferably circumferentially surround the sprinkler frame 12 to preferably axially align the deflector assembly 30 with sprinkler axis A-A as shown in FIGS. 1 and 1A over or during the entire translation. The receiver portion 32 may define a continuous structure surrounding the deflector assembly axis A-A. Alternatively, the receiver portion 32 may be a discontinuous structure, as seen in the deflector assembly 30*b* of FIG. 2B. Accordingly, the receiver portion 32 may be defined by two or more spaced apart segments 32*a*, 32*b* which are arranged to receive and substantially surround the sprinkler frame 12.

Figure 2A:
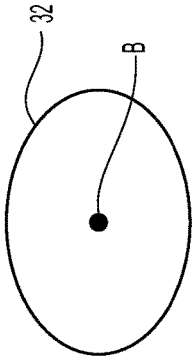
Figure 2A:
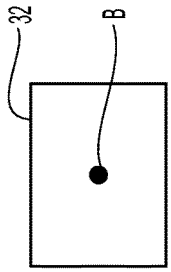
Figure 2A:
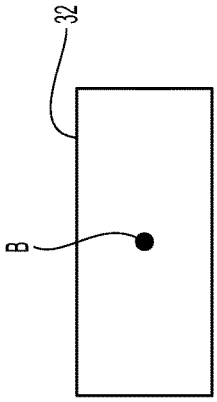

In one preferred embodiment, as seen in FIG. 2A, the receiver portion 32 is substantially circular cylindrical to conform, for example, to the intermediate portion 18 of the sprinkler frame 10 which may be cylindrical at its outer surface. Alternatively, the receiver portion 32 can define non-circular geometries provided the receiver is dimensioned to receive or surround the sprinkler frame 12 and permit the relative translation between the two components 12, 30. For example, the receiver portion 32 can define a rectangular, square or oval geometry, as seen for example in FIGS. 2Ai, 2Aii and 2Aiii, for receiving and surrounding the sprinkler frame 10.

The deflector member 34 is shown generically as a substantially circular member; however, it should be understood that the deflector member 34 is preferably configured in a manner to distribute fluid (water) and address a fire in accordance with industry accepted standards. Accordingly, the deflector member 34 may define any deflector geometry such that the sprinkler assembly performs in accordance with one or more industry accepted performance standards. Provided the deflector member 34 can be coupled to the receiver portion 32 and sprinkler frame 12 in a manner and operation shown and described herein, the deflector member 34 may be defined by a known deflector geometry which satisfies one or more known industry performance standards.

For example, residential automatic fire protection sprinklers are typically designed to specific performance criteria or standards that have been accepted by the industry. The performance criteria establishes the minimum performance standards for a given sprinkler to be considered sufficient for use as a residential fire protection product. For example, Underwriters Laboratories Inc. (UL) "Standard for Safety for Residential Sprinklers for Fire Protection Service" (March 2008) (Rev. April 2012) (hereinafter "UL 1626"), which is incorporated herein in its entirety by reference thereto, is believed to be an accepted industry standard. The National Fire Protection Association (NFPA) also promulgates standards relating to residential fire protection such as, for example, NFPA Standard 13 (2013) (hereinafter "NFPA 13"), which is incorporated in its entirety herein by reference thereto. In order for a residential sprinkler to be approved for installation under NFPA Standards, such sprinkler typically must pass various tests, for example, tests promulgated by UL under UL 1626, in order to be listed for use as a residential sprinkler. Specifically, UL 1626 generally requires a sprinkler to deliver a minimum flow rate (gallons per minute or "gpm") for a specified coverage area (square feet or "$ft^2$") so as to provide for a desired average density of at least 0.05 $gpm/ft^2$. In one particular embodiment, the deflector member 34 may be configured as a known residential deflector provided it can be coupled to a receiver 32 by an extension member 36 as described herein. Exemplary pendent and horizontal sidewall deflectors are shown and described in U.S. Pat. Nos. 8,074,725; 7,201,234; 8,151,897; and U.S. Patent Application Publication Nos. 20090126950; 20100263883 each of which is incorporated by reference in its entirety.

Referring again to FIGS. 2A-2F, extending between the receiver portion 32 and the deflector member 34 is the extension member 36. In one preferred embodiment, the extension member 36 preferably extends parallel to the deflector assembly axis B-B to define a substantially constant radius R to the assembly axis B-B. Accordingly, if the deflector member 34 defines a smaller diameter or width than the receiver portion 32, the extension members may include connection members or portions 38*a*, 38*b* which angle inwardly toward the axis B-B and deflector member 34 to centralize the deflector member. Alternatively, the extension members 36*a*, 36*b* may angle toward the assembly axis B-B such that the assembly tapers narrowly from the receiver portion 32 to the deflector member 34 as seen for example in FIG. 2C so as to be substantially frusto-conical.

Figure 3A:
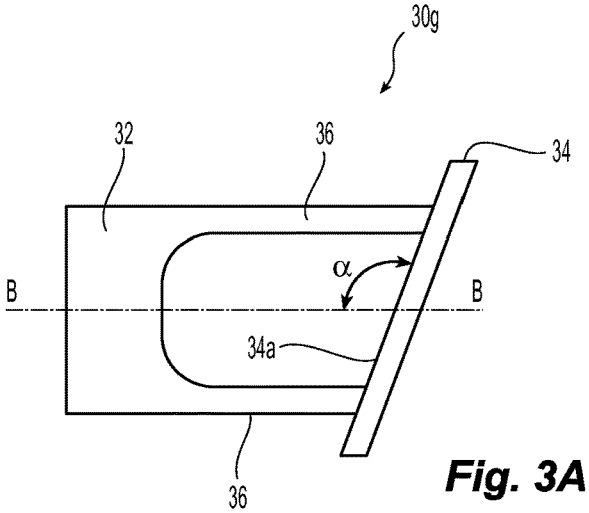
FIGS. 3A-3C show various deflector orientations for use in the sprinkler assembly of FIGS. 1 and 1A.
Figure 3B:
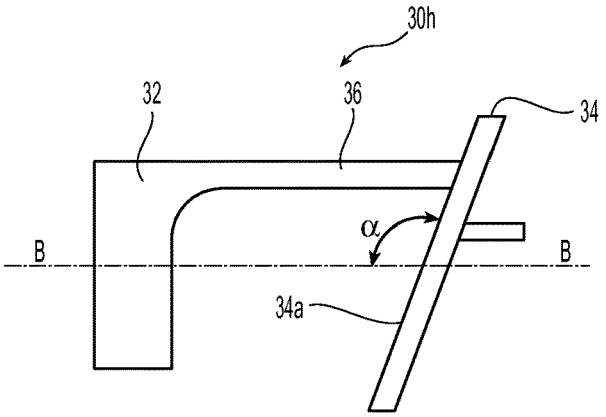
Figure 3C:
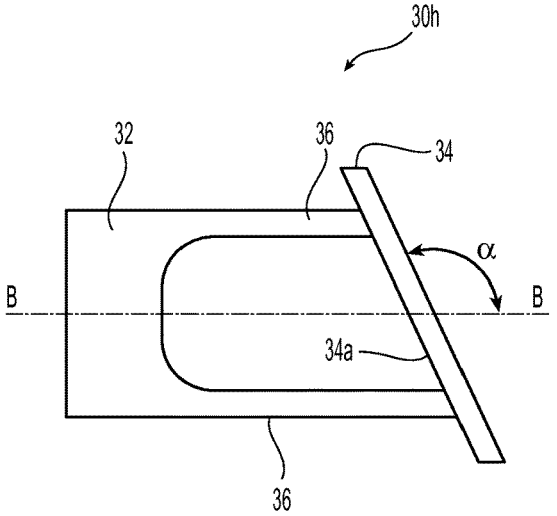

Should the deflector member 34 alternatively define a width, diameter or surface area greater than the receiver portion 32, the extension members 36*a*, 36*b* may angle in a radially outward direction from the assembly axis B-B as seen for example in FIG. 2F. Thus, the extension member(s) 36 or portions thereof can extend or be disposed inside or outside the fluid flow path from the sprinkler frame outlet 20*b*. In each of the preferred embodiments so far shown and described, the deflector member 34 is shown with its impact surface 34*a* normal or orthogonal to the deflector assembly axis B-B. Alternate embodiments are shown in FIG. 3A-3C, in which the deflector is affixed to define an obtuse included angle $\alpha$ between the impact surface 34*a* and the assembly axis B-B.

As shown, each of the extension member(s) 36 are preferably peripherally disposed about or with respect to each of the receiver portion 32 and the deflector member 34. Each of the peripheral extension member(s) 36 present an inner surface 39*a* and an outer surface 39*b* relative to the assembly axis B-B as seen for example in FIG. 2C. One or more of the surfaces may be concave or convex. Moreover, the extension members 36 may present a continuous inner surface to the deflector axis or, alternatively, the member 36 may have one or more voids, such as for example, a through hole or slot 37 seen in each of FIGS. 2D and 2E. In an alternate embodiment of the sprinkler 10 (not shown) in which the deflector assembly 30 remains fixed with respect to the sprinkler frame 12, the opening 37 can engage a corresponding configured projection, such as a detent, on the frame 12 to form a locked mechanical engagement. Where the deflector assembly 30 includes multiple, axially spaced and aligned openings 37, the projection on the frame 12 can be used to form selective engagement between the frame and the voids 37 so as to selectively locate a fixed distance between the deflector member 34 and the outlet 18*b*.

Figure 2G:
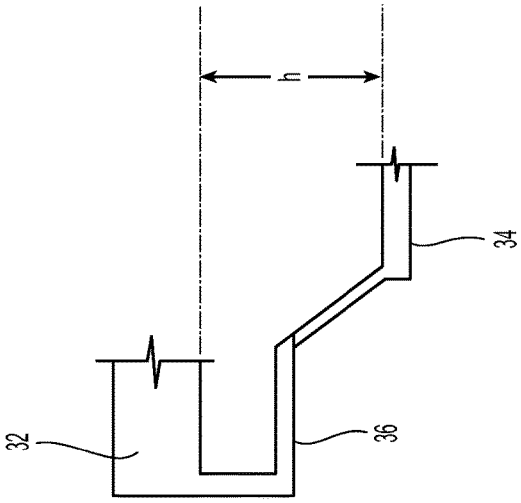

As illustrated in the deflector assembly embodiments of FIGS. 2E and 2F, the peripheral extension members 36 can define a constant or a variable geometry along its axial length. Accordingly, as seen in the deflector assembly 30*e* of FIG. 2E, the extension member 36 defines a preferably constant width along its axial length. Alternatively, as seen in FIG. 2F, the peripheral extension member 36*e* may taper narrowly in either the proximal or distal direction or both. It should be understood that the extension member can include one or more of the geometrical configurations described herein to define a continuous, or step wise extension member 36 from the receiver portion 32 to the deflector member 34 as illustrated in FIG. 2G.

For a deflector assembly 30 having more than one spaced apart extension member 36, as seen for example, in FIG. 2C, the extension members 36 along with the receiver portion 32 and the deflector member 34 can define one or more windows or voids 40*a*, 40*b* in the deflector assembly 30. The geometries of the components of the deflector assembly 30 can define the components individually, but they can also define or characterize the deflector assembly 30 as a whole. In the embodiments of FIGS. 3A and 3C, the lengths of the extension member(s) of the deflector assemblies 30*g*, 30*i* are varied so as to skew or angle the deflector member 34 relative to the assembly axis B-B to define an obtuse included angle $\alpha$ therebetween. In addition to angularly orienting the deflector member 34, the embodiments shown in FIGS. 3A-3C show that the extension member(s) 36 can vertically orient the deflector assembly 30 and its deflector member 34. Accordingly, the extension member(s) 36 can be used to properly orient the sprinkler assembly 10 in a horizontal configuration. Thus, the components of the deflector assembly 30, their surfaces and/or voids can individually or collectively define deflection surfaces of the assembly, which in combination with the deflector member 34 can define the performance of the sprinkler assembly 10.

Preferred embodiments of the deflector assembly 30 are generally cylindrical or frustro-cylindrical in shape. The deflector assembly 30 can be integrally formed by cutting away portions of a cylindrical structure to define the receiver portion 32, deflector member 34, and extension member 36. Alternatively, one or more components of the deflector assembly 30 may be formed from one or more planar blanks of material, i.e, a planar blank of bronze material. As described herein in greater detail, the blank may be cut or stamped, rolled and/or joined by welding, brazing or other joining method to form the deflector assembly 30. Where receiver portion 32 is not a continuous structure as seen in FIG. 2B, the extension members 36 can be formed to bias the receiver portion 32 radially inward or outward to center the deflector assembly about the sprinkler frame 12. In either form of construction, the extension members 36 are preferably formed peripherally with respect to the receiver portion 32 and the deflector member 34.

Referring again to FIGS. 1 and 1A, the preferred sprinkler frame 12 is a body having internal and external surfaces which individually or together define a proximal portion 14, a distal portion 16 and an intermediate frame portion 18 of the sprinkler frame 12 to space the proximal portion 14 from the distal portion 16. The internal surface of the sprinkler frame 12 defines an internal fluid passageway 20 that extends axially from the proximal portion 14 preferably into the distal portion 16. The fluid passage 20 has an inlet 20*a* into which water is supplied and an outlet 20*b* from which the water is discharged for impacting the deflector assembly 30. As shown in the illustrative embodiments of FIGS. 4A and 4B, the fluid passage 120, 220 can include a tapering portion that tapers narrowly in the distal direction and a constant diameter portion that is distal of and contiguous with the tapering portion. The passageway may alternatively have a constant width or taper at a constant rate, variable rate or combinations thereof along its entire length.

The fluid passage 20 of the sprinkler frame 12, inlet 20*a* and outlet 20*b* preferably define a sprinkler constant or K-factor which approximates the flow rate to be expected from an outlet of a sprinkler based on the square root of the pressure of fluid fed into the inlet of the sprinkler. As used herein and in the sprinkler industry, the K-factor is a measurement used to indicate the flow capacity of a sprinkler. More specifically, the K-factor is a constant representing a sprinkler's discharge coefficient that is quantified by the flow of fluid in gallons per minute (GPM) through the sprinkler passageway divided by the square root of the pressure of the flow of fluid fed to the sprinkler in pounds per square inch gauge (PSIG.). The K-factor is expressed as $GPM/(PSI)^{1/2}$. Industry accepted standards, such as for example, the National Fire Protection Association (NFPA) standard entitled, "NFPA 13: Standards for the Installation of Sprinkler Systems" (2010 ed.) ("NFPA 13") provide for a rated or nominal K-factor or rated discharge coefficient of a sprinkler as a mean value over a K-factor range. As used herein, "nominal" describes a numerical value, designated under an accepted standard, about which a measured parameter may vary as defined by an accepted tolerance ranging. When the sprinkler assembly 10 is configured as a residential sprinkler, the sprinkler frame and its internal passage 20 and outlet can be configured to define a K-factor ranging from a nominal 4.1 to a nominal 5.6 $GPM/(PSI)^{1/2}$. In one or more preferred assemblies described herein, the sprinkler frame defines a nominal K-Factor of about 4 GPM/(PSI)$^{1/2}$.

Figure 4A:
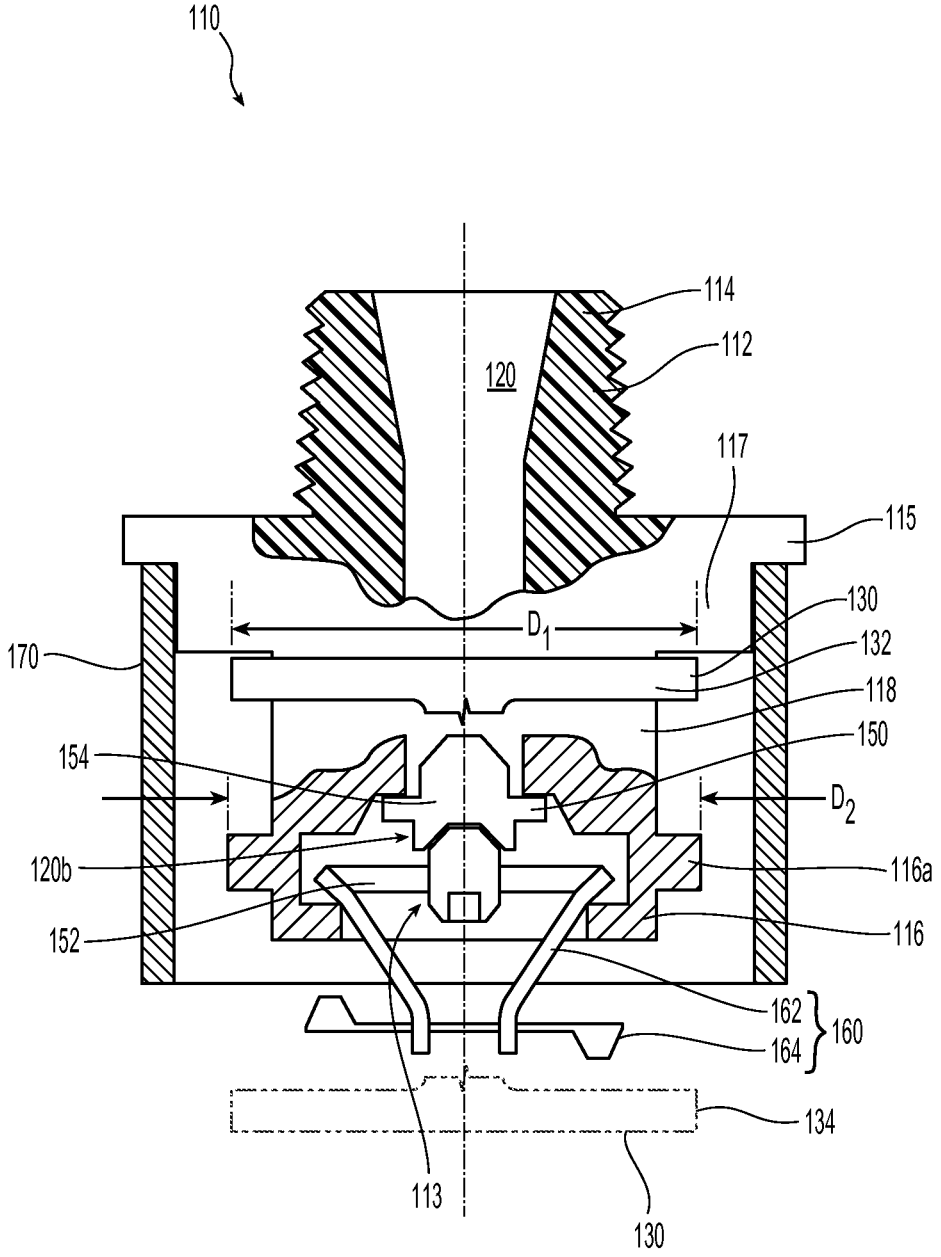
FIG. 4A is a partially cross-sectional view of a preferred embodiment of a fire sprinkler assembly in an unactuated state for use with the deflector assemblies of FIGS. 2A-3C.

As seen in the illustrative embodiment of the sprinkler frame 110 of FIG. 4A, the sprinkler passageway 120 radially can expand at its distal end, and more preferably distal of the outlet 120*b*, to define a chamber 113 to house operational components of the sprinkler assembly 110, such as for example, the seal assembly 150 and the thermally responsive trigger assembly 160. One preferred embodiment of the thermal trigger assembly 160 includes two lever arms or members 162. The lever arms 162 cooperate with a thermally sensitive plate assembly 164 to support the seal assembly 150 in the outlet for maintaining a static fluid pressure preferably ranging from about 175 psi. to about 500 psi. at the outlet 20*b* of the fluid passage upon placement of the sprinkler assembly 10 in service. The seal assembly 150 can include a bridge 152 which is engaged with a closure assembly 154. A preferred seal assembly and a thermally responsive trigger assembly are shown and described in U.S. Patent Application Publication No. 20100263883, which is incorporated by reference in its entirety. An alternate seal assembly and a thermally responsive trigger assembly are shown and described in U.S. Patent Application Publication No. 20090126950, which is incorporated by reference in its entirety.

Figure 4B:
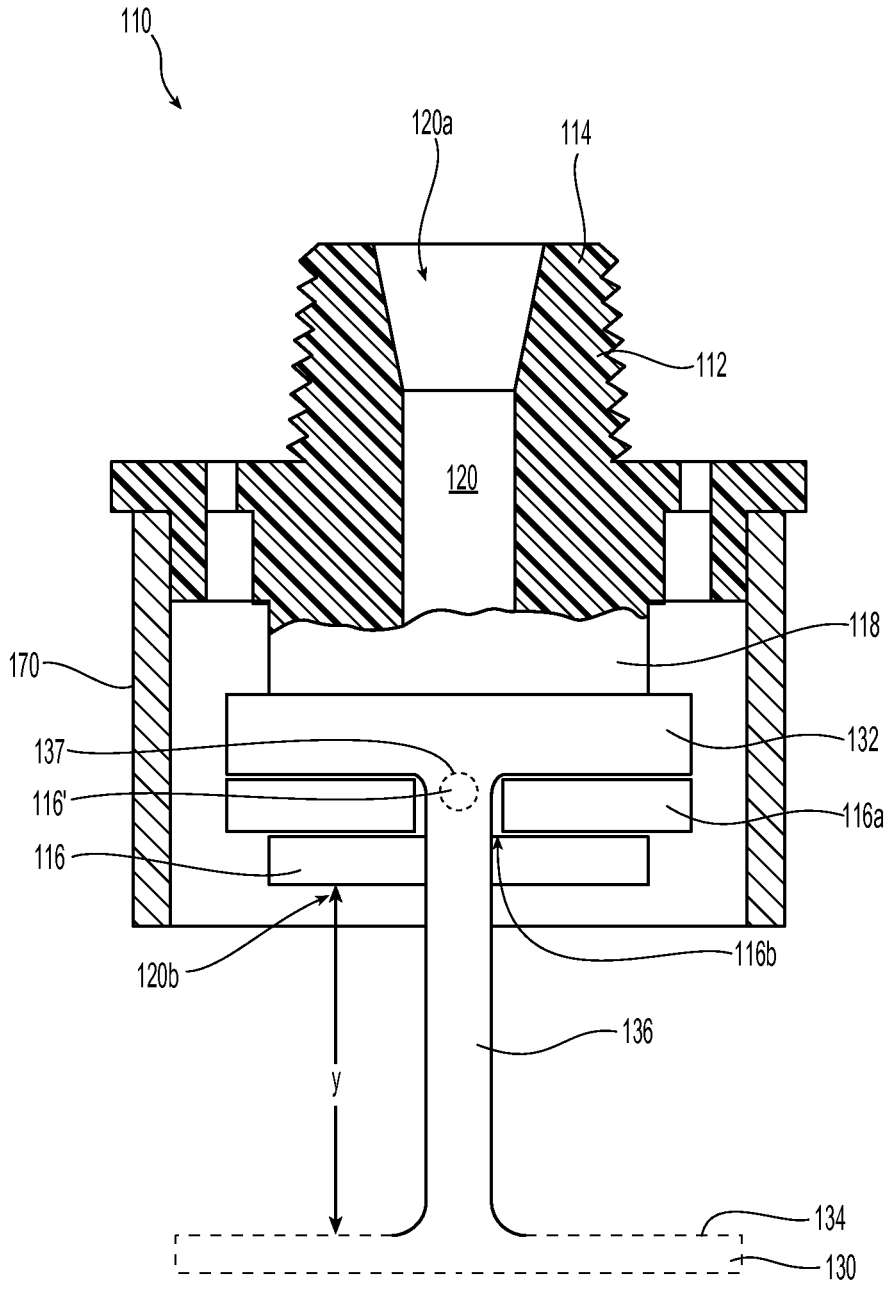
FIG. 4B is a partial cross-sectional view of the sprinkler of FIG. 4A in an actuated state.

Shown in FIGS. 4A and 4B is a preferred embodiment of a sprinkler assembly 110 which includes a sprinkler frame 112 configured to control or limit the axial translation of the deflector assembly 130 with respect to the sprinkler frame 112. In addition to the seal assembly 150, and a thermally responsive trigger assembly 160, as previously described, the sprinkler assembly 110 can include a supporting member 170 surrounding the sprinkler frame 112.

The sprinkler frame 112 includes a proximal end portion 114, a distal end portion 116, and a flange 115 formed between the proximal and distal ends 112, 114 that includes a centering portion 117. The distal end portion 116 preferably includes an external formation 116*a* along the outer surface of the distal end portion 116 that circumscribes the sprinkler frame 112. The external formation 116*a* preferably extends radially outward so as to define a diameter or width at the distal portion of the sprinkler frame that is greater than the receiver portion 132 of the deflector assembly 130. Accordingly, the distal portion 114 of the sprinkler frame 112 can be configured to limit the distal translation of the deflector assembly along the sprinkler frame 112.

Figure 5:
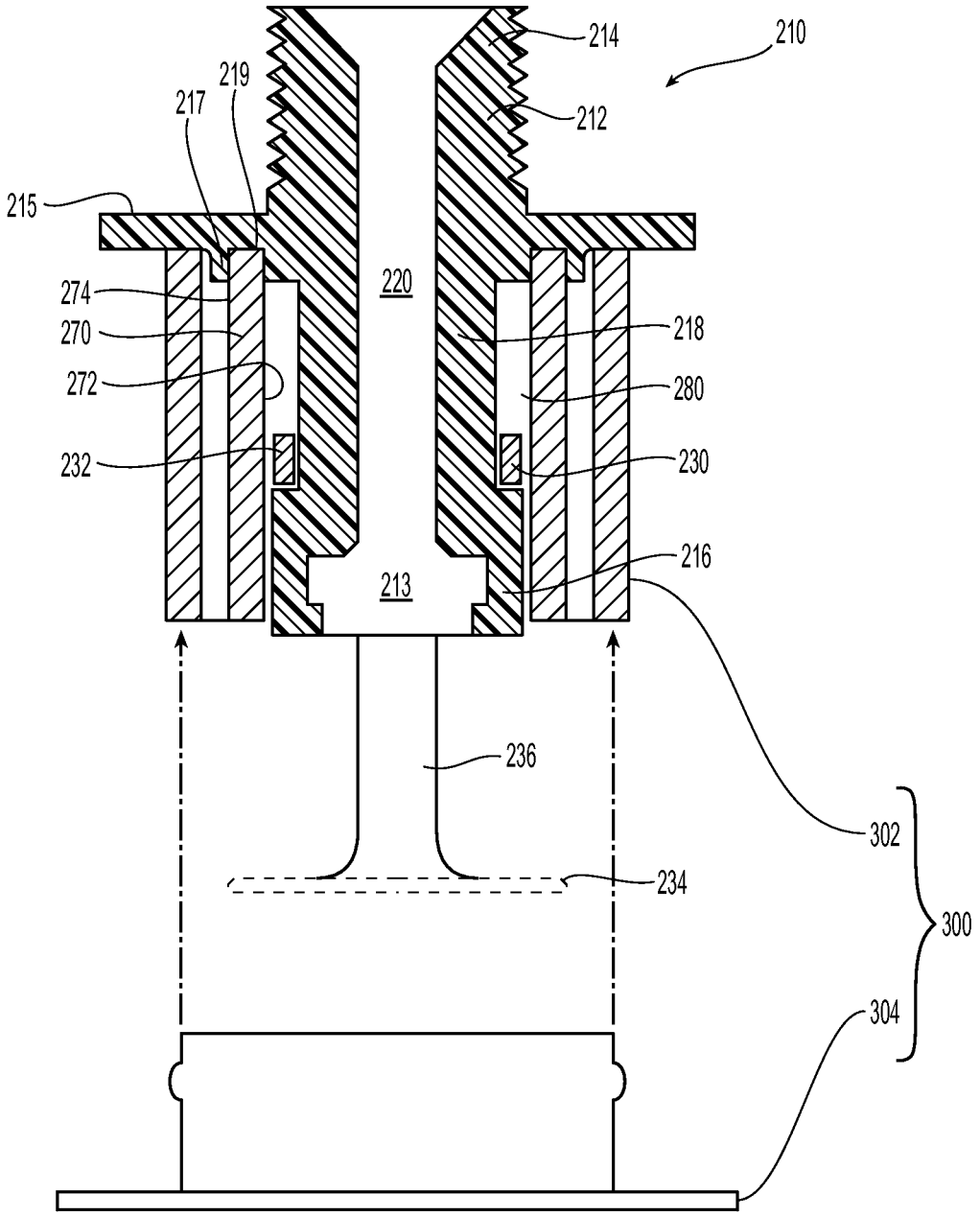
FIG. 5 is a cross-sectional view of another preferred embodiment of a fire sprinkler assembly in an actuated state for use with the deflector assemblies of FIGS. 2A-3C.

Shown in FIG. 4A is the exemplary sprinkler assembly 110 in an unactuated state. The deflector assembly 130 is shown with its receiver portion 132 preferably circumferentially surrounding the intermediate portion 118 of the sprinkler frame 112 adjacent the flange 115 and centering portion 117. The deflector assembly 130 can be supported in its first unactuated position by, for example, a cover plate assembly such as for example a cover plate 304 as seen in FIG. 5. Referring again to FIG. 4A, in a preferred configuration of the receiver portion 132 the receiver portion defines a first width or diameter D1 and the annular formation 116*a* defines a second diameter or width D2 that is preferably greater than the first diameter D1 to limit the translation of the deflector assembly 130. Although the distal formation 116*a* is shown as being circular or annular about the sprinkler frame, the formation 116*a* may be rectangular or non-circular in its formation at the distal end provide it can control or limit the axial translation of the deflector assembly as described herein.

Shown in FIG. 4B, is the sprinkler assembly 110 in an actuated state in which the deflector assembly 130 has translated axially and distally from its first unactuated position to its second actuated position. Given the relative dimensions between the receiver portion 132 of the deflector assembly 130 and the annular formation 116*a*, the annular formation 116*a* controls or limits the axial travel of the deflector assembly 130 upon actuation so as to locate the deflector assembly 130 in its second actuated position and more preferably locates the deflector member 134 at a desired distance Y from the outlet 120*b*. In the actuated position, the deflector assembly 130 and more preferably the receiver portion 132 remain circumferentially disposed about the sprinkler frame. The annular formation 116*a* is preferably formed discontinuously about the distal portion of the sprinkler 116 so as to define a channel 116*b* to accommodate and guide the extension member 136 of the deflector assembly 130. Alternatively, the annular formation 116*a* can be continuous about the distal portion 116 provided the formation 116*a* can limit or control the translation of the deflector assembly 130.

Shown in FIG. 5 is another preferred embodiment of a sprinkler assembly 210 having a sprinkler frame 212, a deflector assembly 230 for preferred axial translation with respect to the sprinkler frame 212 upon sprinkler actuation. The preferred assembly 210 includes a support member or cup 270 disposed about the sprinkler frame 212 and deflector assembly 230. The support cup 270 is a preferably tubular structure and more preferably a substantially circular cylindrical tubular structure having an internal surface 272 and an outer surface 274.

In the particular embodiment of the sprinkler frame 212, the frame includes a flange 215 disposed between the proximal portion 214 and the distal portion 216. A centering element 217 is preferably formed about an intermediate portion of the sprinkler frame 212 and more preferably formed integrally with the flange 215. The centering element 217 can define a transition or projection in the distal direction from the flange 215 to define a shoulder or alternatively an annular channel 219 preferably centered about the internal passage 280. The annular channel 219 is preferably with a depth and a width to engage, support and center the support cup 270 about the sprinkler frame 212. The support cup 170 surrounds and preferably centrally circumscribes the sprinkler frame 212 to preferably define an annular space 280 therebetween. The support cup 270 extends distally and preferably terminates proximal to or even with the distal terminal end of the sprinkler frame 212. Alternatively, the support cup 270 can extend distally of the terminal end of the sprinkler frame 212 provided it does not interfere with the actuated position of the deflector member 134 or the fluid discharge from the outlet.

In the exemplary embodiment of the sprinkler assembly 210 in FIG. 5, the receiver portion 232 is dimensioned and configured with a width or diameter so as to receive and be radially engaged with the sprinkler frame 212. Moreover, the receiver is preferably dimensioned so as to translate within the annular space 280 between the frame 212 and the support cup 270. Again, the external portion of the sprinkler frame about its distal portion 216 can be dimensioned so as to axially control or limit the travel of the deflector assembly 230 and its deflector member 234. Preferably, the distal portion 216 defines a diameter or width greater than the intermediate portion 218 of the sprinkler frame 212 to define the chamber 213 of the sprinkler assembly 210 for housing operational components of the sprinkler assembly as previously described. As with the other preferred embodiments previously described, the deflector member 234 is supported or spaced from the receiver portion 232 by at least one preferably peripheral extension member 236.

The sprinkler assemblies described herein can be configured as a concealed sprinkler and more preferably a residential concealed sprinkler. As shown in FIG. 5, the sprinkler assembly 210 includes a cover assembly 300 having an escutcheon 302 and a cover plate 304. In operation, the cover plate 304 disengages from the escutcheon 302 in response to a fire event, and the thermally responsive trigger assembly (not shown) actuates to release the seal assembly (not shown) to allow water to discharge from the outlet 118*b*, 218*b* and permit axial translation of the deflector assembly 130, 230.

Each of the previously described embodiments of the sprinkler assembly shows a deflector that translates with respect to the sprinkler frame. Alternatively, the sprinkler frame can include a detent or other projecting formation along the outer surface of the sprinkler frame to affix the deflector assembly with respect to the sprinkler frame. Shown in FIG. 4B is an illustrative embodiment of a projection 116' to cooperate with an opening 137 in the deflector assembly 130 to affix the deflector assembly 130 with respect to the sprinkler frame 112. The opening can be configured as a through hole as previously described with respect to FIG. 2D. If the opening 137 is alternatively configured as a slot as seen, for example, in FIG. 2E, the projection 116' and slot engagement can again provide for a translating deflector assembly in which the axial translation is defined or limited by the axial length of the slot.

Referring again to the general sprinkler assembly 10 of FIGS. 1 and 1A, the proximal portion 14 of the sprinkler frame 12 is preferably configured to couple to the sprinkler assembly 10 to an end of a pipe or pipe fitting of a fluid supply line in the piping network. Accordingly, the proximal portion 14 can includes an external thread, such as for example, nominally sized tapered National Pipe Thread (NPT). The external thread preferably ranges in nominal sizes: ½ inch-1¼ inch. The sprinkler frame 12 is preferably formed from a plastic material, such as for example, Chlorinated Polyvinyl Chloride (CPVC) material, more specifically CPVC material per ASTM F442 and substantially similar to the material used to manufacture the BLAZEMASTER® CPVC sprinkler pipe and fittings as shown and described in the technical data sheet, TFP1915: "Blazemaster CPVC Sprinkler Pipe and Fittings Submittal Sheet" (June 2008), which is incorporated by reference in its entirety. Alternatively, the frame can be formed, cast and/or machined from known materials used in the manufacture of sprinkler assemblies, such as cast iron or bronze. In one preferred configuration and installation of the sprinkler assembly, the proximal portion 14 can include an external course pipe thread for engagement with a corresponding internal threaded pipe fitting such as for example a plastic pipe fitting or component as shown and described in PCT Publication WO2013/010098, PCT Application No. PCT/US2012/046717, filed on 13 Jul. 2012, which is incorporated by reference in its entirety. Preferably each of the external thread 40 and internal thread 28 are straight pipe threads such as for example, American Standard straight pipe thread (NPS) or cylindrical threads such as for example, Whitworth-pipe thread, DIN/ISO 228.

Figure 6:
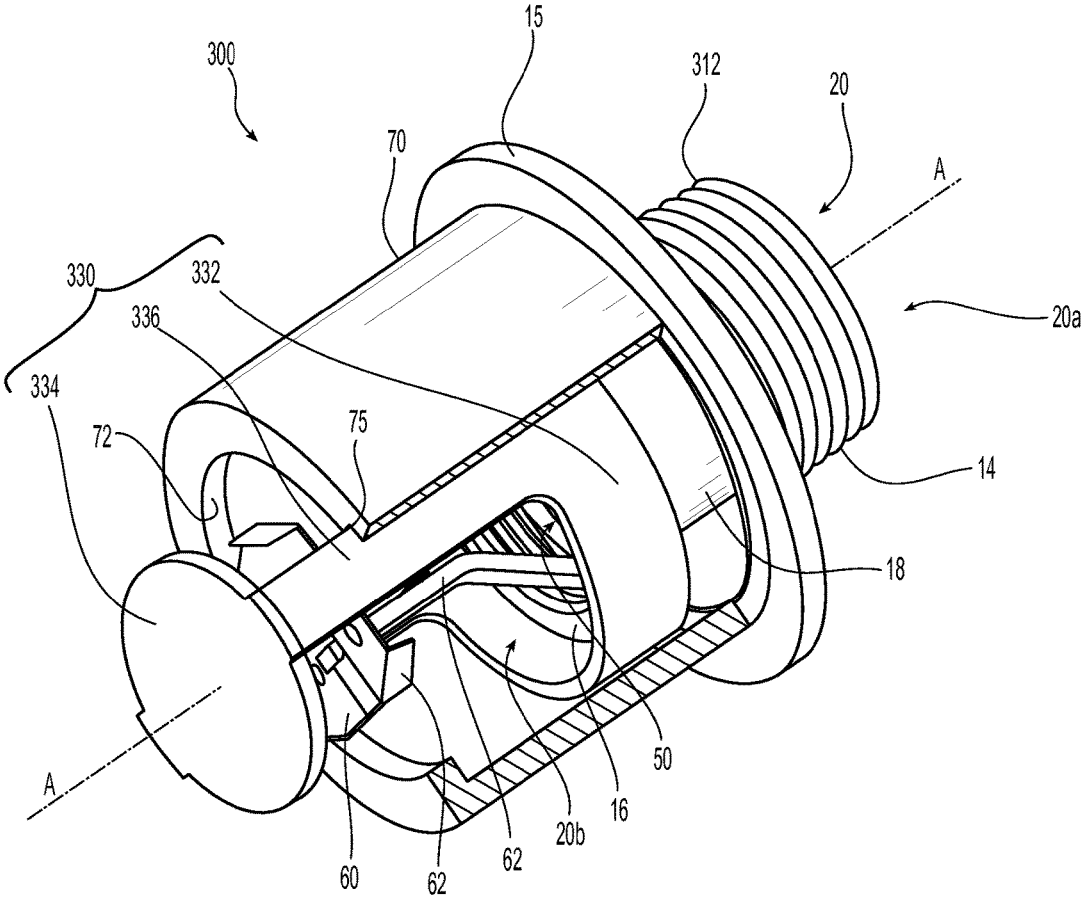
FIG. 6 is a perspective partial cross-sectional view of a preferred sprinkler assembly in an unactuated state.

Shown in FIG. 6 is an illustrative embodiment of a preferred fire protection sprinkler assembly 300. The preferred assembly 300 includes a sprinkler frame 312 and a deflector assembly 330 circumferentially disposed about the sprinkler frame 312. The deflector assembly 330 is preferably configured to translate relative to the sprinkler frame 312. The preferred assembly 300 includes a support member 370 disposed about the sprinkler frame 312 and deflector assembly 30. In one particular embodiment, the support member 370 is configured to guide and center the deflector assembly 330 about the sprinkler frame 312. More preferably, the support member 370 defines the first position of the deflector assembly 330 in the unactuated state of the sprinkler assembly 300 and the second position of the deflector assembly 30 in the actuated state.

The deflector assembly 330 can be configured with any one of the features shown in the deflector assemblies of FIGS. 2A-2F and 3A-3C. In one preferred embodiment, the receiver portion 332 is substantially circular cylindrical to conform to, for example, a circular cylindrical interior surface of the support member 370.

Figure 7A:
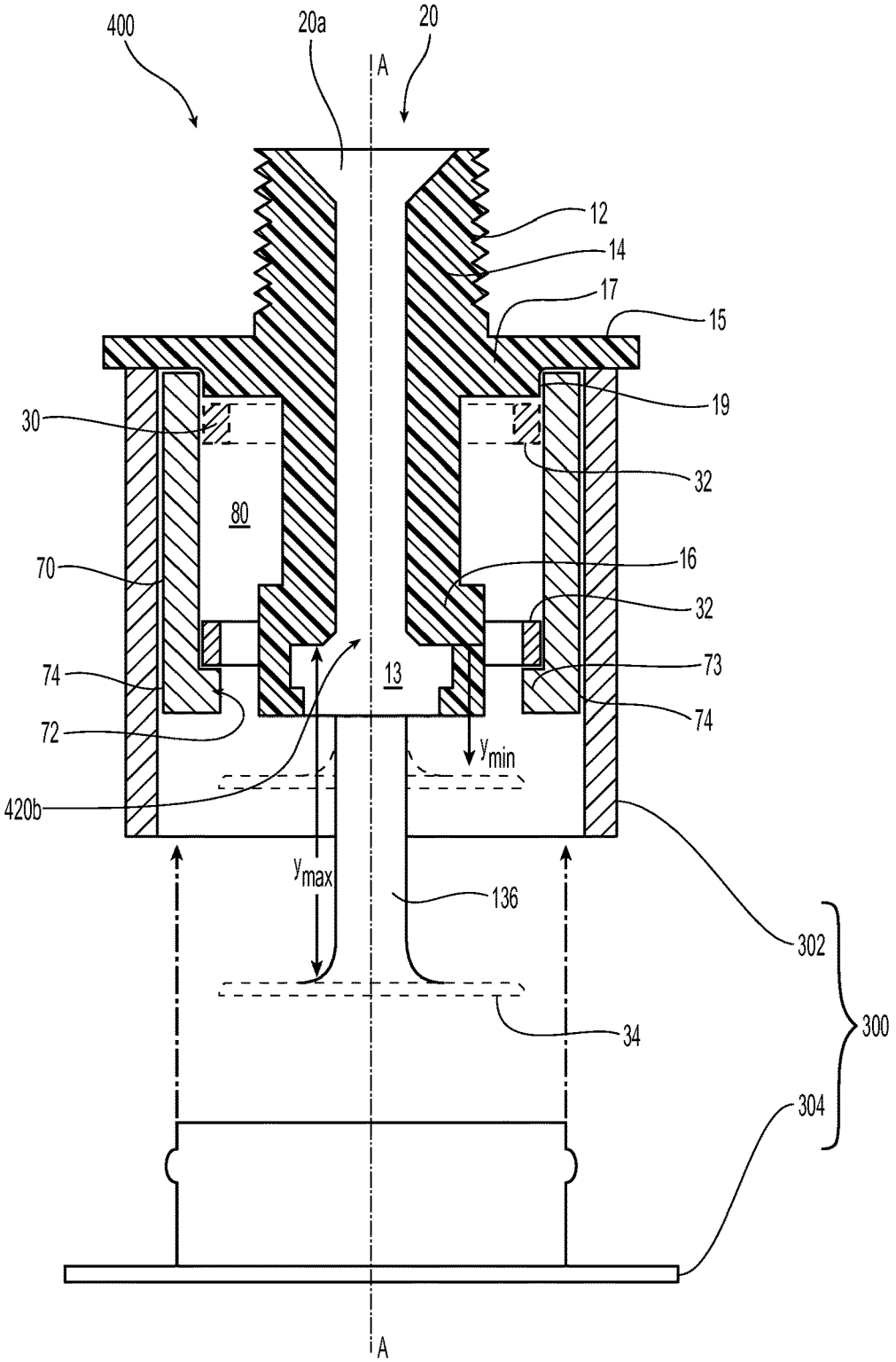
FIG. 7A is a cross-sectional view of a preferred embodiment of a sprinkler assembly.
Figure 7B:
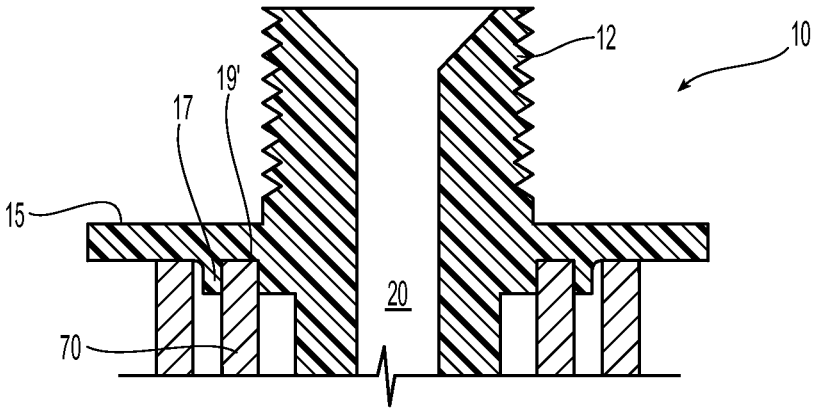
FIG. 7B is a partial cross-sectional view of another embodiment of a sprinkler assembly.

Shown in FIG. 7A is the sprinkler assembly 400 in an actuated state. The support cup 70 is a tubular structure and more preferably a substantially circular cylindrical tubular structure having an internal surface 72 and an outer surface 74. Although the outer surface 74 is shown as continuous, it should be understood that the support can include one or more through holes or openings extending from its outer surface 74 through to its inner surface 72. The support cup 70 preferably engages the sprinkler frame 12. In one embodiment of the sprinkler frame 12, the frame includes a flange 15 disposed between the proximal portion 14 and the distal portion 16. A centering element 17 is preferably formed about an intermediate portion of the sprinkler frame 12 and more preferably formed integrally with the flange 15. The centering element 17 can define a transition or projection in the distal direction to define a shoulder 19. The proximal portion of the supporting cup 70 is preferably engaged with and centered on the flange 15 and more preferably engaged and centered about the centering element 17 so that the support cup 70 surrounds and preferably centrally circumscribes the sprinkler frame 12 to preferably define an annular space 80 therebetween. Alternatively to a shoulder 19, the centering element 17 can include a formed annular channel with a depth and a width to engage, support and center the proximal end of the support cup 70 about the sprinkler frame 12 as seen, for example, in FIG. 7B. Referring again to the exemplary assembly 10 of FIG. 7A, the support cup 70 extends distally and preferably terminates proximal to or even with the distal terminal end of the sprinkler frame 12. Alternatively, the support cup 70 can extend distally of the terminal end of the sprinkler frame 12 provided it does not interfere with the actuated position of the deflector member 34 or the fluid discharge from the outlet 420*b*.

Located within the annular space 80 is the receiver portion 32 of the deflector assembly 30. Shown in phantom is the receiver portion 32 in its first position adjacent the flange 15 to locate the deflector member 34 in its unactuated position at its minimum distance Ymin from the outlet 420*b*. In its first position, the receiver portion 32 preferably circumferentially surrounds the intermediate portion 18 of the sprinkler frame 12. The receiver portion 32 is shown in solid line in its second position axially spaced from the flange 15 to locate the deflector member 34 in its actuated position at its maximum distance Ymax from the outlet 420*b*. In the actuated position, the deflector assembly 30 and more preferably the receiver portion 32 remain circumferentially disposed about the sprinkler frame.

The receiver portion 32 may be radially engaged with or radially spaced from either the sprinkler frame 12, the support cup 70 or both. Accordingly, the annular channel 80 can define a guide rail for the receiver portion 32 and the deflector assembly 30 to translate from the first unactuated position to the second actuated position. For example, as shown in FIG. 4A, the receiver portion 32 is dimensioned and configured with a width or diameter so as to engage the inner surface 72 of the supporting member cup 70. The support cup 70 preferably includes an annular shoulder 73 that extends circumferentially about the inner surface 72 and radially toward the sprinkler axis to limit axial translation of the deflector assembly 30. Moreover, the shoulder can be formed continuously about the sprinkler axis. Alternatively, the shoulder can be discontinuous so as to define or include an axially extending notch or recess 75, as seen in FIG. 6, to guide the preferably peripheral extension members 36 in translation. As shown in FIG. 7A, the sprinkler assembly 400 includes a cover assembly 330 having an escutcheon 332 and a cover plate 334, in which the cover plate 334 disengages from the escutcheon 332 in response to a fire event.

Figure 8B:
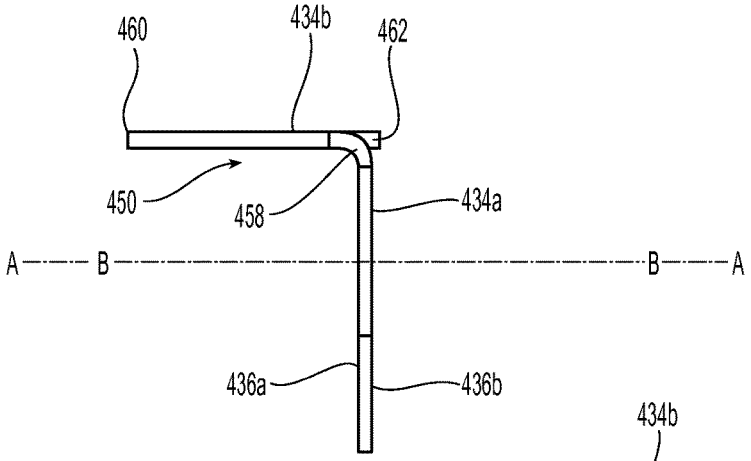
FIGS. 8-8D are various views of multiple embodiments of a deflector assembly for use in the sprinkler assembly of FIGS. 1A-1B.
FIG. 8E is a illustrative blank of material for forming the deflector assembly in FIGS. 8-8D.
Figure 8:
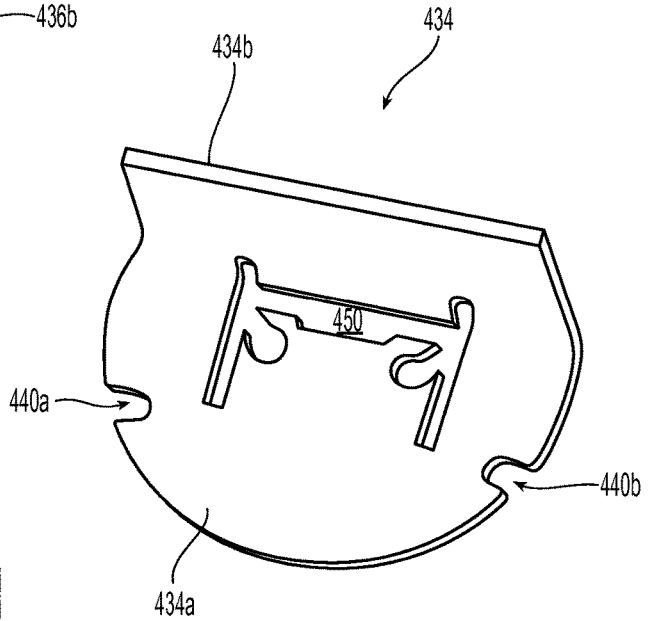
Figure 8A:
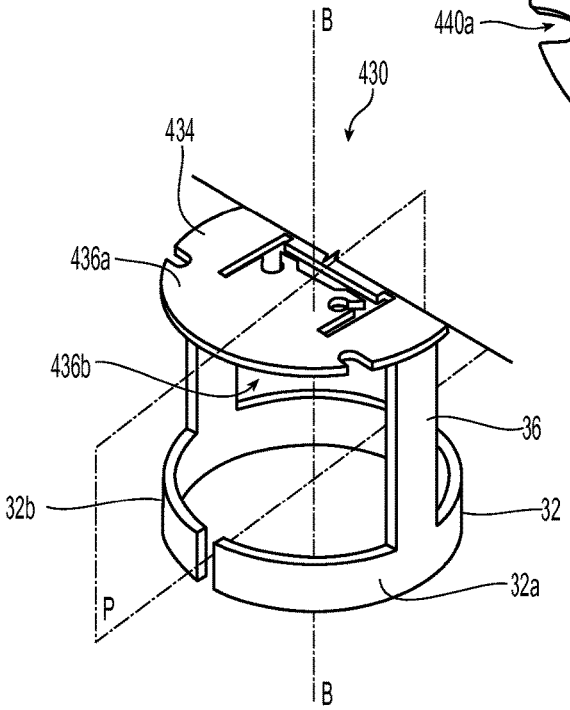

Referring again to FIG. 6, a preferred horizontal sidewall deflector assembly 330 is generically shown. Shown in FIGS. 8-8D is a preferred embodiment of a horizontal deflector 434 for use in a preferred deflector assembly 430. The deflector member 434 is a preferably unitary member having a face plate portion 434*a* and a canopy portion 434*b* angled with respect to the face plate 434*a* and extending distally from the face plate 434*a*. The canopy portion 434*b* is preferably disposed orthogonally with respect to the face plate 434*a*. With reference to FIG. 8A, shown is a partial isometric view of the deflector assembly 430 with the preferred deflector member 434 (the canopy has been removed for clarity). In the assembly, the receiver 432 and extension members orient the deflector member so as to define a distal surface 436*a* of the face plate 434*a* and an opposite proximal surface 436*b* to be opposed to the sprinkler outlet 20*b*. Preferably, the proximal surface 436*a* of the face plate 434*a* includes a portion that intersects and is more preferably perpendicular to the sprinkler axis A-A defined by the passageway 20 and its outlet 20*b*. Given the configuration of the deflector assembly described herein, the extension members are preferably disposed laterally of the sprinkler axis A-A. Thus, with preferably no structures located between the outlet 20*b* of the sprinkler frame 12 and the proximal surface 436*b* of the deflector member in the actuated state of the sprinkler, as described herein, the proximal surface 436*a* of the deflector assembly presents an initial impact surface for fluid discharge from the outlet. Thus, the preferred embodiments of the sprinkler assembly preferably provide for a unitary deflector member that, in a horizontal arrangement, presents an impact surface which is the first surface impacted by a fluid flow discharge without the flow being impeded by other structures.

Figure 8C:
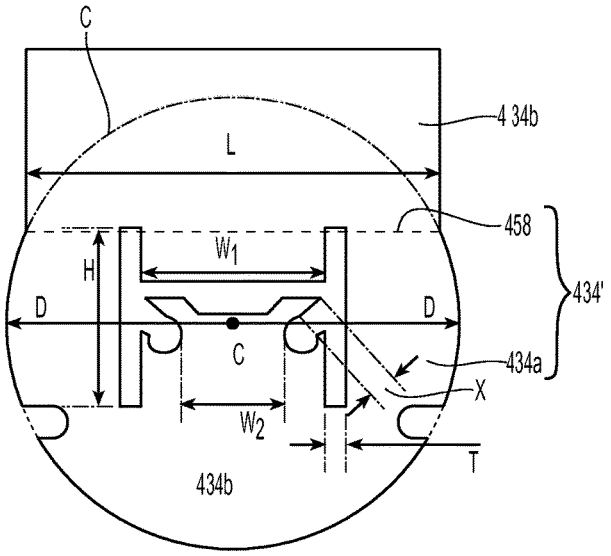
Figure 8D:
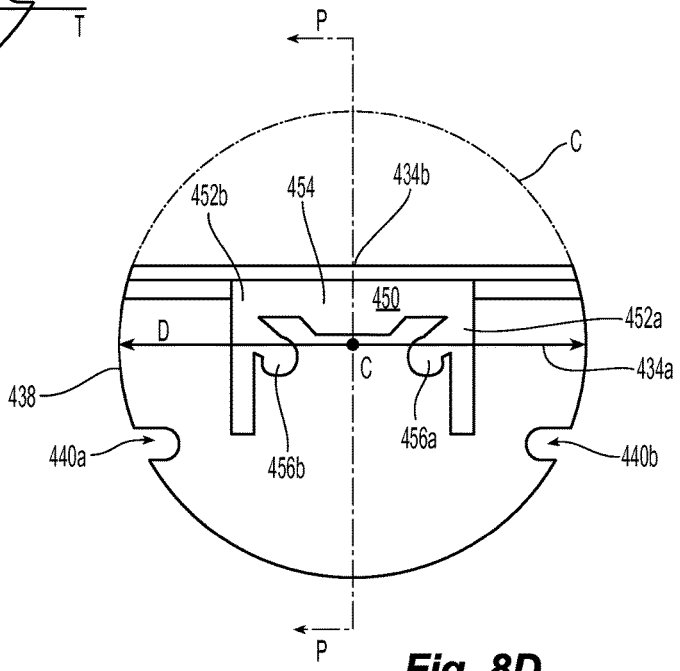

Referring to FIG. 8A and the distal view of the deflector member 434 in FIG. 8C, the deflector is preferably symmetrical about a plane P. In the sprinkler assembly 400, the sprinkler axis A-A is preferably disposed in the plane P. As shown in FIG. 8C, the face plate 434*a* has a preferably arcuate peripheral edge 438 that is more preferably defined by a circumference of a circle C having a center axis C-C preferably located on the surfaces 436*a*, 436*b* of the face plate 434. The center C is preferably parallel to and more preferably coaxially aligned with the deflector assembly axis B-B and/or the sprinkler axis A-A. The peripheral edge 438 may be continuous or more preferably includes one or more slots. In one preferred embodiment, as shown in FIG. 8C, the peripheral edge 438 includes two slots 440*a*, 440*b* which extend toward the plane of symmetry P.

In addition to the peripheral slots, the deflector member 434 preferably includes a plurality of internal surfaces including a plurality of connected parallel internal edges to define a closed-form fluid flow aperture 450 of the deflector member 434. The flow aperture 450 is preferably formed and located in the deflector assembly 430 such that the aperture does not intersect the sprinkler axis A-A so that the proximal surface of the face plate defines the preferably initial impact surface of the sprinkler assembly 400. With the closed formed aperture 450 formed by a plurality of linear edges, the aperture 450 can be defined by a plurality of overlapping voids. In the preferred embodiment of the deflector member 434, the aperture 450 includes a pair of lateral voids 452*a*, 452*b* disposed about and extending parallel to the axis of symmetry. Preferably interconnecting the pair of lateral voids 452*a*, 452*b* is a central void 454 having a length extending perpendicular to the axis of symmetry and a width extending parallel to the axis of symmetry. Preferably, the plurality of parallel edges define the central void 454 such that the central void has a medial width greater than a lateral width. Further preferably formed between each lateral void 452*a*, 452*b* and the central void 454 is an angular slot 456*a*, 456*b*. The slots 456*a*, 456*b* are preferably angled toward the plane of symmetry and formed so as to include a linear portion and a circular portion with the circular portion being medial of the linear portion to terminate the slots 456*a*, 456*b*. In the preferred formation of the deflector member 434, the central void 454 is preferably formed between the canopy 434*b* and the circular portions 456*a*, 456*b*.

The deflector member 434 is preferably a unitary member. Accordingly, the deflector member is preferably cut or punched from a blank 434', as seen for example in FIG. 8D. As previously noted, the deflector assembly 30 can be integrally formed by cutting away portions of a cylindrical structure to define the receiver portion 32, deflector member 34, and extension member 36. Alternatively, one or more components of the deflector assembly 30 may be formed from one or more blanks of material, i.e., a bronze blank of material. The planar blank 434' is preferably cut or punched to define the face plate portion 434*a* and the canopy 434*b* with the bend line 458 defined therebetween. Preferred embodiments of the deflector assembly 430 are generally cylindrical or frustro-cylindrical in shape. The blank may be cut or stamped, rolled and joined by welding, brazing or other joining method to form the sprinkler assembly 400. Where receiver portion 32 is not a continuous structure as seen in FIG. 8A, the extension members 36 can be formed to bias the receiver portion 32 radially inward or outward to center the deflector assembly about the sprinkler frame 12.

The preferred fluid flow aperture 450 is also cut or punched into the blank 434'. As shown, the aperture 450 crosses the bend line 458 such that the aperture is preferably formed in each of the face place 434*a* and the canopy portion 434*b*. The bend line 458 preferably defines a chord length L of the circle C, which defines the diameter of the preferably partially circular face plate 434*a*. Preferably the bend line 458 defines a cord length L to diameter ratio of about 0.9:1. Referring to FIG. 8B, the bend line 458 and the aperture 450 result in the canopy portion having a distal edge 460 that extends preferably parallel to the bend line 458. The canopy further preferably includes a proximal edge 462. Preferably, the face plate 434*a* and its proximal surface 436*b* is disposed axially between the distal edge 460 and the proximal edge 462.

Referring again to the partial view of the deflector assembly shown in FIG. 8A, the receiver portion 32 defines a central axis B-B of the deflector assembly 430 and the extension members couple the deflector member 434 to the receiver 32 so as to preferably centrally align the deflector member 434 along the central axis B-B as illustratively shown in the deflector assembly 430 of FIG. 8A. Because the sprinkler frame 12 translates within the receiver portion 32 upon sprinkler actuation, the receiver portion 32 is geometrically configured to surround and more preferably circumferentially surround the sprinkler frame 12 to preferably axially align the deflector assembly 430 with sprinkler axis A-A as shown in FIG. 1 over or during the entire translation. The receiver portion 32 may define a continuous structure surrounding the deflector assembly axis A-A. Alternatively, the receiver portion 32 may be a discontinuous structure, as seen in the deflector assembly 430 of FIG. 8A. Accordingly, the receiver portion 32 may be defined by two or more spaced apart segments 32*a*, 32*b* which are arranged to receive and substantially surround the sprinkler frame 12.

In one preferred embodiment, as seen in FIG. 8A, the receiver portion 32 is substantially a circular cylindrical or annular member to conform to, for example, a circular cylindrical interior surface of the support member or cup 70. Preferably, the receiver portion 32 defines a diameter that is about equal to the diameter D of the face plate 434*a*. Thus, the extension members 36 preferably extend parallel to and preferably radially spaced from the deflector assembly axis B-B or sprinkler axis A-A. Accordingly, if the deflector member 434 defines a smaller diameter or width than the receiver portion 32, the extension members may include connection members or portions 438*a*, 438*b* which angle inwardly toward the axis B-B and deflector member 434 to centralize the deflector member. Alternatively, the extension members 436 may angle toward the assembly axis B-B such that the assembly tapers narrowly from the receiver portion 32 to the deflector member 434 so as to be substantially frusto-conical. Should the deflector member 434 alternatively define a width, diameter or surface area greater than the receiver portion 32, the extension members 436 may angle in a radial direction away or toward the assembly axis B-B provided the extension members remain clear of the fluid discharge path in the actuated state of the sprinkler so that the proximal surface 436*b* defines the initial or first impact surface of the sprinkler upon actuation.

The deflector member 434 and its fluid flow aperture 450 and slots 440*a*, 440*b* are preferably configured in a manner to distribute fluid (water) and address a fire in accordance with industry accepted standards. Accordingly, the deflector member 434 may define a deflector geometry such that the sprinkler assembly performs in accordance with one or more industry accepted performance standards such as, for example, the residential automatic fire protection sprinkler standards previously described.

Referring to FIGS. 8D and 8C and the formation of the preferred aperture 450, the lateral voids 452*a*, 452*b* are preferably rectangular extending parallel to the bisecting plane P having a first end proximate the bend line 458 and a second end proximate the slots 440*a*, 440*b*. Each rectangular lateral void 452*a*, 452*b* defines a preferred width of about 0.05 inch and an axial length H of about 0.5 inch. The central void 454 is an elongate void that preferably extends parallel to the bend line 458 to define an axial length W1 of about 0.6 inch and more preferably 0.56 inch to define a preferred distance between the lateral voids 452*a*, 452*b*. The centered portion of the central void 454 defining the maximum width of the void 454 has a preferred axial length W2 of about 0.22 inch. Preferably laterally disposed about the center portion of the central void 454 are angular slots 456*a*, 456*b*. The angular slots 456*a*, 456*b* preferably include a linear portion having a length x of about 0.07 inch from the lateral void to the circular portion of the angled slot. The circular portion preferably defines a radius of curvature R of about 0.05 inch. Each of the lateral slots 456*a*, 456*b* has a preferred width that is equal to the radius of curvature at its closed end which is preferably about 0.05 inch. The lateral slots 456*a*, 456*b* are preferably disposed below the void 450 with one lateral edge linearly aligned with the second end of the lateral voids 452*a*, 452*b*.

Figure 8E:
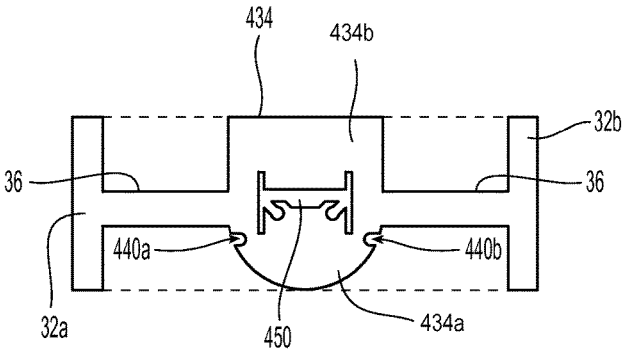

Shown in FIG. 8E is an illustrative embodiment of a preferred deflector assembly cut from a planar blank of material. More specifically shown is a one piece planar rectangular blank, from which, each of the deflector member 434, extension members 36 and the receiver segments 32*a*, 32*b* is cut or stamped. The deflector member 434, extension members 36 and the receiver segments 32*a*, 32*b* are cut adjacent one another to facilitate formation of the sprinkler assembly. For example, the extension members 36 and receiver segments 32*a*, 32*b* are cut or stamped preferably symmetrically about the deflector member 434. Moreover, the extension members 36 are cut so as to be disposed between the receiver segments 36 and the deflector member 434 so that the extension members 36 axially space the deflector member 434 from the receiver segments 32 in the final formation of the deflector assembly 430. Alternatively, the blank can be cut so that a single receiver segment is cut at the terminal end of one of the extension members 36. Additionally, the extension members are cut or stamped so that the extension members 36 terminate at the peripheral edges of each of the deflector member 434 and the receiver segments 32*a*, 32*b*. The transitions between the extension members 36 and the peripheral edges of the deflector member 434 and the receiver segments further preferably define a bend line for formation of the deflector assembly 430. The receiving segment are further preferably bent or curved for appropriately receiving the sprinkler frame in a manner as previously described.

Each of the features of the deflector member 434 are also preferably formed and/or cut from the one-piece blank. More specifically, each of the face plate portion 434*a* and canopy 434*b* are cut or stamped from the blank. The face plate portion 434*a* is cut or stamped to include the slots 440*a*, 440*b* along the peripheral edge and the central fluid flow aperture 450 previously described. The canopy 434*b* is cut with the face plate portion 434*a* to provide for the bend line so that the canopy 434*b* can be accordingly angled with respect to the face plate portion in the final formation of the deflector assembly 430. Accordingly, with the deflector features cut from the blank, the blank can be appropriately bent at the junctions between the deflector features so as to form any one of the preferred deflector assemblies previously described. Although FIG. 8E and its description are made with respect to the deflector assembly of FIGS. 8-8D it should be understood that the described method of forming is applicable to any of the deflector assemblies described herein.

Figure 9A:
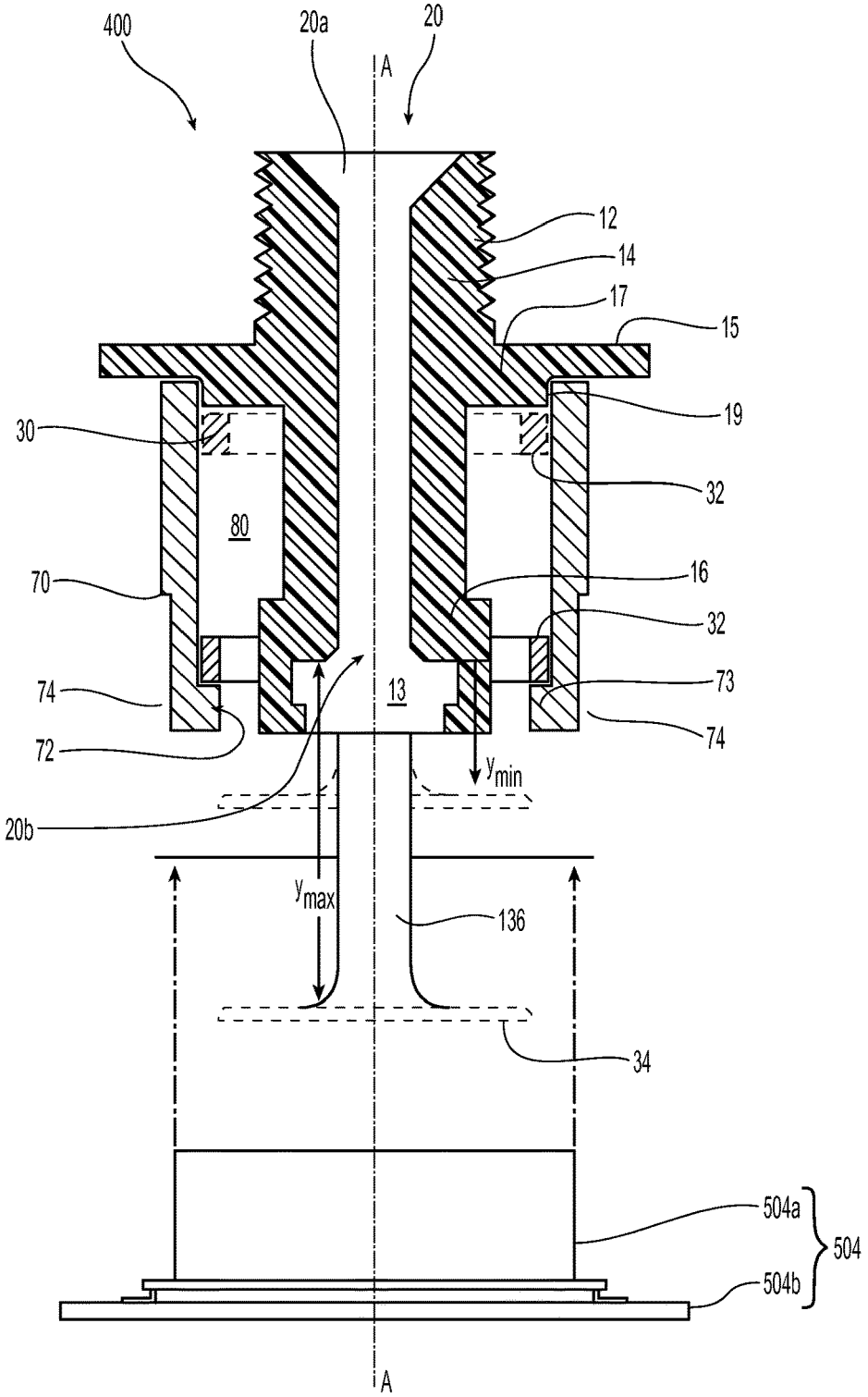
FIG. 9A is a cross-sectional view of a preferred embodiment of a sprinkler assembly.

Shown in FIG. 9A is the sprinkler assembly 400 including the support member or cup 70. The support cup 70 is a tubular structure and more preferably a substantially circular cylindrical tubular structure having an internal surface 72 and an outer surface 74. The surfaces can be continuous or alternatively discontinuous. As shown in FIG. 9A, the receiver portion 32 is dimensioned and configured with a width or diameter so as to engage the inner surface 72 of the supporting member or cup 70. The support cup 70 preferably includes an annular shoulder 73 that extends circumferentially about the inner surface 72 and radially toward the sprinkler axis to limit axial translation of the deflector assembly 30. The sprinkler assemblies described herein can be configured as a concealed sprinkler and more preferably a residential concealed sprinkler. As shown in FIG. 9A, the sprinkler assembly 400 includes a cover assembly 504 having a cover plate for engagement about the outer surface 74 of the distal portion of the support cup 70. The preferred cover assembly 504 includes a retainer ring 504*a* and a cover plate 504*b* with a fusible solder material coupling the cover plate 504*b* to the retainer ring. The outer surface 74 at the distal portion of the support cup 70 preferably includes a reduced outer diameter to preferably define a shoulder or notched transition along the outer surface 74 to facilitate the pushed-on engagement of the cover plate 504 about the support cup. The retainer ring 504*a* preferably forms a press-fit engagement about the support cup 70 to maintain the cover plate disposed about the support cup 70. The outer surface 74 or the retainer ring 504*a* may be alternatively configured, for example, including cooperating bumps, ridges and recesses to provide for an alternate mechanical engagement for retaining the cover plate assembly about the support cup. In the event of a sufficiently intense fire, the solder of the cover plate assembly 504 melts and the cover plate 504*b* disengages from the retainer ring 504*a*.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler assembly comprising:

a sprinkler frame having a proximal portion, a distal portion and an intermediate portion extending between the proximal portion and the distal portion, the sprinkler frame having an outer surface and an inner surface, the inner surface defining an inlet at the proximal portion into which a fluid is supplied, an outlet at the distal portion of the sprinkler frame from which fluid is discharged, the inner surface extending from the inlet to the outlet to define a fluid passageway along a sprinkler axis;

a seal assembly supported in the outlet for preventing discharge of firefighting fluid from the sprinkler frame, the seal assembly including a bridge engaged with a closure assembly; and a deflector assembly having a receiver portion, a deflector member and least one extension member between the receiver portion and the deflector member to space the deflector member from the receiver portion along a central deflector axis and define a window between the receiver portion and the deflector member, the receiver portion being a discontinuous structure including a plurality of spaced apart segments arranged to receive and surround the sprinkler frame, the at least one extension member being peripheral with respect to the receiver portion and the deflector member, the receiver portion being disposed between the proximal and distal portions of the sprinkler frame about the intermediate portion to axially align the deflector axis with the sprinkler axis, the deflector member including an impact surface opposed to the outlet of the sprinkler frame for impact by fluid discharge from the outlet, the window extending axially from the receiver portion to the impact surface.

2. The sprinkler assembly of claim 1, wherein the at least one peripheral extension member has at least one opening for engaging the outer surface of the sprinkler frame to fix the deflector assembly with respect to the sprinkler frame.

3. The sprinkler assembly of claim 2, wherein the at least one peripheral extension member includes a plurality of openings to selectively affix the deflector assembly to the sprinkler frame.

4. The sprinkler assembly of claim 1, wherein the deflector assembly translates from a first proximal position to a second distal position, the deflector assembly surrounding the sprinkler frame in each of the first and second position.

5. The sprinkler assembly of claim 4, further comprising an escutcheon and a cover plate assembly, the deflector assembly translates from a first proximal position to a second distal position, the cover plate supporting the deflector assembly in the first proximal position to define an unactuated state of the sprinkler assembly.

6. The sprinkler assembly of claim 4, wherein the distal portion of the sprinkler frame has an outer surface including a formation, the formation limiting axial translation of the deflector assembly in the distal direction.

7. The sprinkler assembly of claim 6, wherein the receiver portion is a substantially circular cylindrical member defining a first diameter, the formation extending radially from the distal portion to define a width of the distal portion that is greater than the first diameter.

8. The sprinkler assembly of claim 6, wherein the formation defines an annular formation about the distal portion of the sprinkler frame.

9. The sprinkler assembly of claim 6, wherein the annular formation defines a channel to guide the extension member in the axial translation of the deflector assembly.

10. The sprinkler assembly of claim 1, further comprising a support member surrounding the sprinkler frame to define an annular space therebetween, the receiver portion being disposed in the annular space to axially align the deflector axis with the sprinkler axis.

11. The sprinkler assembly of claim 10, wherein the inner surface of the support member includes an annular shoulder, the shoulder limiting axial translation of the deflector assembly in the distal direction.

12. The sprinkler assembly of claim 1, wherein the deflector member defines an obtuse angle with respect to the deflector axis.

13. The sprinkler assembly of claim 1, wherein the sprinkler frame is a plastic sprinkler frame.

14. The sprinkler assembly of claim 13, wherein the sprinkler frame is of CPVC material.

15. A horizontal sidewall sprinkler assembly comprising:

a sprinkler frame having a proximal portion, a distal portion and an intermediate portion extending between the proximal and distal portion, the sprinkler frame having an outer surface and an inner surface, the inner surface defining a fluid passageway having an inlet to a fluid supply and an outlet having a seal assembly supported therein, the seal assembly including a bridge engaged with a closure assembly, the fluid passageway extending from the inlet to the outlet along a sprinkler axis;

a deflector comprising:

a receiver portion located between the proximal and distal portions of the sprinkler frame and disposed about the intermediate portion, the receiver portion being a discontinuous structure including a plurality of spaced apart segments arranged to receive and surround the sprinkler frame;

a unitary deflector member axially and distally spaced from the receiver portion, the deflector member including a face plate and a canopy angled with respect to the face plate and extending distally from the face plate, the face plate having an impact surface opposed to the outlet of the sprinkler frame, intersecting and orthogonal to the sprinkler axis; and a pair of peripheral extension members extending from the receiver portion to the deflector member to define a window and space the deflector member from the outlet such that the fluid path from the outlet to the impact surface plate is unimpeded, the window extending axially from the receiver portion to the impact surface.

16. The horizontal sidewall sprinkler assembly of claim 15, wherein the face plate has a peripheral edge defined by a circumference of a circle having a center axis parallel to the sprinkler axis, the diameter or the circle defining the maximum width of the face plate member, the angle between the canopy and the face plate defining a bend line of the deflector member, the bend line defining a cord length of the circle the ratio of the cord length to diameter being about 0.9:1.

17. The horizontal sidewall sprinkler assembly of claim 16, wherein the face plate includes a plurality of slots formed along the peripheral edge symmetrically disposed about a plane of symmetry of the deflector member.

18. The horizontal sidewall sprinkler assembly of claim 15, wherein the deflector member defines a plane of symmetry about which the face plate is symmetrical, the sprinkler axis being disposed in plane of symmetry, the deflector member including a plurality of internal edges to define a closed formed aperture symmetrically formed about the plane of symmetry and around the sprinkler axis, the aperture includes a pair of lateral voids disposed about and extending parallel to the axis of symmetry, a central void interconnecting the pair of lateral voids, the central void having a length extending perpendicular to the axis of symmetry and a width extending parallel to the axis of symmetry, the plurality of edges include a plurality of parallel edges to define the central void, the central void having a medial width greater than a lateral width, each of the lateral voids includes a slot angled toward the plane of symmetry, the slot having a linear portion and a circular portion being medial of the linear portion.

19. The horizontal sidewall sprinkler assembly of claim 18, wherein the lateral voids are rectangular having a width of about 0.05 inch and a length of about 0.5 inch, the central void being elongate having a length of about 0.6 inch to separate the lateral voids, wherein the linear portion of the angled slot has a length of about 0.07 inch and a circular portion having a radius of curvature about 0.05 inch.

20. The horizontal sidewall sprinkler assembly of claim 15, further comprising a support cup having an internal surface disposed about the sprinkler frame, the internal surface of the support cup forming an annular lip distal of the distal portion of the sprinkler frame, wherein the deflector assembly axially translates with respect to the sprinkler frame, the receiver portion engaging the annular lip to limit the axial translation.

21. A horizontal sidewall sprinkler assembly comprising:

a sprinkler frame having a proximal portion, a distal portion and an intermediate portion extending between the proximal and distal portions, the sprinkler frame having an outer surface and an inner surface, the inner surface defining a fluid passageway having an inlet to a fluid supply and an outlet for fluid discharge, the fluid passageway extending from the inlet to the outlet along a sprinkler axis;

a deflector assembly comprising:

a receiver portion located between the proximal and distal portions of the sprinkler frame and disposed about the intermediate portion, the receiver portion being a discontinuous structure including a plurality of spaced apart segments arranged to receive and surround the sprinkler frame;

at least one extension member extending peripherally from the receiver portion to define a window; and a deflector member axially and distally spaced from the receiver portion by the at least one extension member disposed peripherally with respect to the deflector member, the deflector member including a face plate and a canopy angled with respect to the face plate and extending distally from the face plate, the deflector member being symmetrical about an axis of symmetry, the sprinkler axis disposed in the axis of symmetry, the face plate having a first distal surface and a second proximal surface opposed to the outlet of the sprinkler frame and intersecting the sprinkler axis to define an initial impact surface for the fluid discharge from the outlet of the sprinkler frame, the window extending from the receiver portion to the initial impact surface.

22. The sprinkler assembly of claim 21, further comprising a cover plate assembly and a support cup, the support cup having an outer surface with a notched transition for a push-on engagement with the cover plate assembly, the deflector assembly translates from a first proximal position to a second distal position, the cover plate supports the deflector assembly in the first proximal position to define an unactuated state of the sprinkler assembly.

23. A horizontal sidewall sprinkler for the assembly comprising:

a sprinkler frame having a proximal portion, a distal portion and an intermediate portion extending between the proximal portion and the distal portion, the sprinkler frame having an outer surface and an inner surface, the inner surface defining a fluid passageway having an inlet to a fluid supply and an outlet for fluid discharge, the fluid passageway extending from the inlet to the outlet along a sprinkler axis; and a deflector assembly including:

a unitary deflector member including a face plate having a fluid flow aperture and a surface opposed to the outlet of the sprinkler frame, intersecting and orthogonal to the sprinkler axis;

a receiver portion coupled to the deflector member, the receiver portion being a discontinuous structure including a plurality of spaced apart segments arranged to receive and surround the sprinkler frame, the receiver portion being located between the proximal and distal portions of the sprinkler frame and disposed about the intermediate portion of the sprinkler frame for axial translation relative to the outlet, the receiver portion and deflector member being in a fixed spaced relationship such that translation of the receiver portion provides for translation of the deflector member relative to the outlet of the sprinkler frame; and a pair of extension members disposed about the periphery of the deflector member and the receiver portion, to define a window extending from the receiver portion to the deflector member.

24. A sprinkler assembly comprising:

a plastic sprinkler frame having a proximal portion, a distal portion and an intermediate portion extending between the proximal and distal portion, the sprinkler frame having an outer surface and an inner surface, the inner surface defining an inlet at the proximal portion into which a fluid is supplied, an outlet at the distal portion from which fluid is discharged, the inner surface extending from the inlet to the outlet to define a fluid passageway along a sprinkler axis; and a deflector assembly having a receiver portion, a deflector member and at least one extension member between the receiving portion and the deflector member to space the deflector member from the receiver portion along a central deflector axis and define a window extending from the receiver portion to the deflector member, the receiver portion being a discontinuous structure including a plurality of spaced apart segments arranged to receive and surround the sprinkler frame, the at least one extension member being peripheral with respect to the receiver portion and the deflector member, the receiver portion being located between the proximal and distal portions of the sprinkler frame and disposed about the intermediate portion to axially align the deflector axis with the sprinkler axis, the at least one peripheral extension member having at least one opening for engaging the outer surface of the sprinkler frame to fix the deflector assembly with respect to the sprinkler frame.

25. The sprinkler assembly of claim 24, wherein the peripheral extension member includes a plurality of openings to selectively affix the detector assembly to the sprinkler frame.

26. The sprinkler assembly of claim 25, wherein the sprinkler frame includes a projection for engaging the plurality of openings.

* * * * *